US008384314B2

(12) United States Patent
Treas et al.

(10) Patent No.: US 8,384,314 B2
(45) Date of Patent: Feb. 26, 2013

(54) TRAVELING WAVE LINEAR ACCELERATOR COMPRISING A FREQUENCY CONTROLLER FOR INTERLEAVED MULTI-ENERGY OPERATION

(75) Inventors: Paul Dennis Treas, Livermore, CA (US); Roger Heering Miller, Mountain View, CA (US); Juwen Wang, Sunnyvale, CA (US)

(73) Assignee: Accuray, Inc., Sunnyvale, CA (US)

( * ) Notice: Subject to any disclaimer, the term of this patent is extended or adjusted under 35 U.S.C. 154(b) by 0 days.

(21) Appl. No.: 13/551,527

(22) Filed: Jul. 17, 2012

(65) Prior Publication Data

US 2013/0016814 A1 Jan. 17, 2013

Related U.S. Application Data

(63) Continuation of application No. 12/581,086, filed on Oct. 16, 2009, now Pat. No. 8,232,748.

(60) Provisional application No. 61/147,447, filed on Jan. 26, 2009, provisional application No. 61/233,370, filed on Aug. 12, 2009.

(51) Int. Cl.
*H05H 9/00* (2006.01)

(52) U.S. Cl. ..... 315/505; 315/503; 315/5.42; 378/98.9; 378/113; 378/138; 378/145; 250/390.1; 250/396 R; 250/397

(58) Field of Classification Search ..... 315/5.41, 315/5.42, 5.46, 3.5, 3.6, 39.3, 500, 505, 503; 378/98.9, 101, 109, 110, 113, 116, 121, 138, 378/145, 150, 151; 250/305, 390.1, 393, 250/396 R, 397, 398, 492.3
See application file for complete search history.

(56) References Cited

U.S. PATENT DOCUMENTS

| | | | | |
|---|---|---|---|---|
| 2,993,141 | A * | 7/1961 | Post | 315/5.42 |
| 4,118,653 | A * | 10/1978 | Vaguine | 315/5.41 |
| 4,713,581 | A * | 12/1987 | Haimson | 315/5.41 |
| 4,835,446 | A * | 5/1989 | Nation et al. | 315/5.13 |
| 8,203,289 | B2 * | 6/2012 | Ho et al. | 315/505 |
| 8,232,748 | B2 * | 7/2012 | Treas et al. | 315/505 |
| 8,284,898 | B2 * | 10/2012 | Ho et al. | 378/119 |
| 8,311,187 | B2 * | 11/2012 | Treas et al. | 378/119 |

* cited by examiner

*Primary Examiner* — Haiss Philogene
(74) *Attorney, Agent, or Firm* — Jones Day; Jaime D. Choi

(57) ABSTRACT

An electromagnetic wave having a phase velocity and an amplitude is provided by an electromagnetic wave source to a traveling wave linear accelerator. The traveling wave linear accelerator generates a first output of electrons having a first energy by accelerating an electron beam using the electromagnetic wave. The first output of electrons can be contacted with a target to provide a first beam of x-rays. The electromagnetic wave can be modified by adjusting its amplitude and the phase velocity. The traveling wave linear accelerator then generates a second output of electrons having a second energy by accelerating an electron beam using the modified electromagnetic wave. The second output of electrons can be contacted with a target to provide a second beam of x-rays. A frequency controller can monitor the phase shift of the electromagnetic wave from the input to the output ends of the accelerator and can correct the phase shift of the electromagnetic wave based on the measured phase shift.

15 Claims, 13 Drawing Sheets

TRAVELING WAVE LINEAR ACCELERATOR COMPRISING A FREQUENCY CONTROLLER FOR INTERLEAVED MULTI-ENERGY OPERATION

1. CROSS-REFERENCE TO RELATED APPLICATIONS

This application is a continuation under 35 U.S.C. §120 of U.S. patent application Ser. No. 12/581,086, filed Oct. 16, 2009 now U.S. Pat. No. 8,232,748 and entitled "Traveling Wave Linear Accelerator Comprising a Frequency Controller for Interleaved Multi-Energy Operation," the entire contents of which are incorporated by reference herein, which claims priority to U.S. Provisional Application No. 61/147,447, filed Jan. 26, 2009 and U.S. Provisional Application No. 61/233,370, filed Aug. 12, 2009, the entire contents of both of which are incorporated by reference herein.

2. TECHNICAL FIELD

The invention relates to systems and methods for interleaving operation of a traveling wave linear accelerator comprising a frequency controller, for use in generating electrons at least two different energy ranges. The electrons can be used to generate x-rays of at least two different energy ranges.

3. BACKGROUND

Large scale containers are typically used to transport goods internationally and domestically. Quantities of such containers are loaded and unloaded at ports on an ongoing basis. Due to the large quantity of containers that are received at ports, port inspectors may not be able to open the containers to inspect their contents. This can pose a security risk.

To address the security risk introduced by an inability to open and inspect the contents of shipping containers, cargo inspection devices have been developed that scan the insides of the containers without requiring inspectors to open the containers. Conventional cargo inspection devices perform radioscopic examination of shipping containers using an X-ray beam or gamma beam that can penetrate the container to identify its contents. For inspecting filled shipping containers, a cargo inspection device that produces X-ray beams using an accelerator is typically used because of the high energy output (and therefore greater penetration) that it provides.

Typically, the linear accelerators used in cargo inspection systems are configured to produce a single energy X-ray beam. A detector receives the single energy X-ray beam that has penetrated the shipping container without being absorbed or scattered, and produces an image of the contents of the shipping container. The image can be displayed to an inspector who can perform visual inspection of the contents.

Some cargo inspection devices use dual energy linear accelerators that are configured to emit two different energy level X-ray beams. With a dual energy X-ray inspection system, materials can be discriminated radiographically by alternately irradiating an object with X-ray beams of two different energies. Dual energy X-ray inspection systems can determine a material's mass absorption coefficient, and therefore the effective atomic (Z) number of the material. Differentiation is achieved by comparing the attenuation ratio obtained from irradiating the container with low-energy X-rays to the attenuation ratio obtained from irradiating the container with high-energy X-rays. Discrimination is possible because different materials have different degrees of attenuation for high-energy X-rays and low-energy X-rays, and that allows identification of low-Z-number materials (such as but not limited to organic materials), medium-Z-number materials (such as but not limited to transition metals), and high-Z-number materials (such as but not limited to radioactive materials) in the container. Such systems can therefore provide an image of the cargo contents and identify the materials that the cargo contents are comprised of.

The ability of dual energy X-ray inspection systems to detect the Z number of materials being scanned enables such inspection systems to automatically detect the different materials in a container, including radioactive materials and contraband such as but not limited to cocaine and marijuana. However, conventional dual energy X-ray inspection systems use a standing wave linear accelerator that is vulnerable to frequency and power jitter and temperature fluctuations, causing the beam energy from the linear accelerator to be unstable when operated to accelerate electrons to a low energy. The energy jitter and fluctuations can create image artifacts, which cause an improper Z number of a scanned material to be identified. This can cause false positives (in which a targeted material is identified even though no targeted material is present) and false negatives (in which a targeted material is not identified even though targeted material is present).

4. SUMMARY

As disclosed herein, a traveling wave linear accelerator is provided comprising an accelerator structure having an input and an output; an electromagnetic wave source coupled to the accelerator structure to provide an electromagnetic wave to the accelerator structure; and a frequency controller interfaced with the input and output of the accelerator structure. The frequency controller can be used to compare the phase of the electromagnetic wave at the input of the accelerator structure to the phase of the electromagnetic wave at the output of the accelerator structure to detect a phase shift of the electromagnetic wave. The frequency controller transmits a signal to an oscillator, and the oscillator can cause the electromagnetic wave source to generate a subsequent electromagnetic wave at a modified frequency based on the magnitude of the phase shift detected by the frequency controller. The electromagnetic wave source can be a klystron.

The frequency controller can be operably connected to the oscillator, the frequency controller can transmit the signal to adjust the frequency settings of the oscillator, and the oscillator can generate a frequency signal that causes the electromagnetic wave source to generate the subsequent electromagnetic wave at the modified frequency. In another example, the frequency signal from the oscillator can be amplified by an amplifier, and the amplifier can supply the amplified frequency signal to the electromagnetic wave source. The traveling wave linear accelerator can further comprise an electron gun coupled to the input of the accelerator structure to provide one or more electron beams to the accelerator structure.

A system and method of operating the traveling wave linear accelerator also is provided. An example system and method can comprise accelerating a first electron beam from an electron gun to a first energy using a first electromagnetic wave provided by the electromagnetic wave source, where the frequency controller monitors a first phase shift of the first electromagnetic wave, and transmits a first signal to the oscillator based on the magnitude of the first phase shift. The system and method can further comprise accelerating a second electron beam from the electron gun to a second energy, different from the first energy, using a second electromagnetic wave provided by the electromagnetic wave source and having a different amplitude and phase velocity from the first electromagnetic wave, where the frequency controller monitors a second phase shift of the second electromagnetic wave, and transmits a second signal to the oscillator based on the magnitude of the second phase shift. The first energy and the second energy can be interleaved. The first electron beam can be emitted from the output of the accelerator structure at the first energy and contacted with a target to produce a first beam of x-rays at a first range of x-ray energies. The second electron beam can be emitted from the output of the accelerator structure at the second energy and contacted with a target to produce a second beam of x-rays at a second range of x-ray energies.

In addition, a system and method of operating a traveling wave linear accelerator are provided, comprising coupling a first electromagnetic wave having a first frequency and a first amplitude from an electromagnetic wave source to an input of an accelerator structure of the traveling wave linear accelerator, accelerating a first electron beam injected by an electron gun into the accelerator structure to a first energy using the electromagnetic wave, and monitoring the first phase shift of the electromagnetic wave using a frequency controller interfaced with the input and an output of the accelerator structure. The frequency controller can compare the phase of the electromagnetic wave at the input of the accelerator structure to the phase of the electromagnetic wave at the output of the accelerator structure to monitor the first phase shift. The frequency controller can transmit a first signal to a first oscillator, and the first oscillator can cause the electromagnetic wave source to generate a subsequent electromagnetic wave at a corrected frequency based on the magnitude of the phase shift of the electromagnetic wave detected by the frequency controller. The system and method can further comprise emitting the first electron beam from the output of the accelerator structure at the first energy and contacting the first electron beam with a target to produce a first beam of x-rays at a first range of x-ray energies. The system and method can further comprise coupling a modified electromagnetic wave having a second frequency and a second amplitude from the electromagnetic wave source to the input of the accelerator structure, accelerating a second electron beam injected by the electron gun into the accelerator structure to a second energy, different from the first energy, using the modified electromagnetic wave, and monitoring a second phase shift of the modified electromagnetic wave using the frequency controller. The frequency controller can compare the phase of the modified electromagnetic wave at the input of the accelerator structure to the phase of the modified electromagnetic wave at the output of the accelerator structure to monitor the second phase shift and transmit a second signal to the second oscillator. The second oscillator can cause the electromagnetic wave source to generate a subsequent modified electromagnetic wave at a corrected frequency based on the magnitude of the second phase shift of the modified electromagnetic wave. The first energy and the second energy can be interleaved. The systems and methods can further comprise emitting the second electron beam from the output of the accelerator structure at the second energy and contacting the second electron beam with a target to produce a second beam of x-rays at a second range of x-ray energies. The electromagnetic wave source can be a klystron.

A system and method of operating a traveling wave linear accelerator also are provided, comprising coupling a first electromagnetic wave having a first amplitude and a first frequency in an accelerator structure of the traveling wave linear accelerator from an electromagnetic wave source to an input of the accelerator structure, generating a first output of electrons having a first energy from an output of the accelerator structure by accelerating a first electron beam using the first electromagnetic wave, and monitoring the first phase shift of the first electromagnetic wave using a frequency controller interfaced with the input and output of the accelerator structure. The frequency controller can compare the phase of the first electromagnetic wave at the input of the accelerator structure to the phase of the first electromagnetic wave at the output of the accelerator structure and transmit a first signal to an oscillator. The oscillator can cause the electromagnetic wave source to generate a second electromagnetic wave at a second frequency based on the magnitude of the first phase shift of the first electromagnetic wave. The system and method can further comprise contacting the first output of electrons with a target to produce a first beam of x-rays at a first range of x-ray energies. The systems and methods can further comprise coupling a third electromagnetic wave having a third amplitude and a third amplitude in the accelerator structure from the electromagnetic wave source to the input of the accelerator structure, and generating a third output of electrons having a third energy, different from the first energy, by accelerating a third electron beam using the third electromagnetic wave, and monitoring the third phase shift of the third electromagnetic wave using the frequency controller. The frequency controller can compare the phase of the third electromagnetic wave at the input of the accelerator structure to the phase of the third electromagnetic wave at the output of the accelerator structure and transmit a signal to an oscillator. The oscillator can cause the electromagnetic wave source to generate a fourth electromagnetic wave at a fourth frequency based on the magnitude of the phase shift of the third electromagnetic wave detected by the frequency controller. The systems and methods can further comprise contacting the third output of electrons with a target to produce a third beam of x-rays at a third range of x-ray energies. The electromagnetic wave source can be a klystron As also disclosed herein, a traveling wave linear accelerator is provided comprising an accelerator structure having an input and an output, an electromagnetic wave source coupled to the accelerator structure to provide an electromagnetic wave to the accelerator structure, an electron energy spectrum monitor positioned near the output of the accelerator structure, and a frequency controller interfaced with the electron energy spectrum monitor. The electron energy spectrum monitor provides (a) an indication of a first energy spectrum of a first output of electrons from the output of the accelerator structure, where the first output of electrons was accelerated in the accelerator structure using a first electromagnetic wave having a first amplitude and a first frequency, and (b) an indication of a second energy spectrum of a second output of electrons from the output of the accelerator structure, where the second output of electrons was accelerated in the accelerator structure using a second electromagnetic wave having a second amplitude and a second frequency. The first amplitude can have about the same magnitude as the second amplitude. The first frequency can have a different magnitude than the second frequency. The frequency controller can compare the indication of the first energy spectrum to the indication of the second energy spectrum and transmit a signal to an oscillator based on the comparison. The oscillator can cause the electromagnetic wave source to generate a third electromagnetic wave at a third frequency and a third amplitude to maximize and thus stabilize the energy of a third output of electrons accelerated using the third electromagnetic wave. The third amplitude can have about the same magnitude as the first amplitude.

A traveling wave linear accelerator is also provided comprising an accelerator structure having an input and an output, an electromagnetic wave source coupled to the accelerator structure to provide an electromagnetic wave to the accelerator structure, an x-ray yield monitor positioned near the output of the accelerator structure, and a frequency controller interfaced with the x-ray yield monitor. The x-ray yield monitor provides (a) an indication of a first yield of a first beam of x-rays at the output of the accelerator structure, where the first beam of x-rays is generated using a first set of electrons that is accelerated in the accelerator structure by a first electromagnetic wave having a first amplitude and a first frequency, and (b) an indication of a second yield of a second beam of x-rays at the output of the accelerator structure, where the second beam of x-rays is generated using a second set of electrons that is accelerated in the accelerator structure by a second electromagnetic wave having a second amplitude and a second frequency. The second amplitude can have about the same magnitude as the first amplitude. The second frequency can be of a different magnitude than the first frequency. The frequency controller can compare the indication of the first yield of the first beam of x-rays to the indication of the second yield of the second beam of x-rays and transmit a signal to an oscillator based on the comparison. The oscillator can cause the electromagnetic wave source to generate a third electromagnetic wave at a third frequency and a third amplitude to maximize the yield of a third beam of x-rays generated using a third set of electrons that is accelerated in the accelerator structure by the third electromagnetic wave. The third amplitude can have about the same magnitude as the first amplitude.

Systems and methods of tuning a traveling wave linear accelerator also are provided comprising providing an electromagnetic wave having a range of phase velocities in the LINAC and an amplitude, generating a first X-ray beam having a first energy level by accelerating an electron beam using the electromagnetic wave, modifying the electromagnetic wave by adjusting the amplitude and the phase velocities, and generating a second X-ray beam having a second energy level by accelerating the electron beam using the modified electromagnetic wave.

5. BRIEF DESCRIPTION OF THE DRAWINGS

The present invention is illustrated by way of example, and not by way of limitation, in the figures of the accompanying drawings.

6. DETAILED DESCRIPTION

For accelerators that are configured to generate multiple different energies, the accelerator should be separately tuned at each of the energy levels to provide maximum efficiency at the highest energy level, and to maximize stability at each energy level. The following sections describe a traveling wave linear accelerator (TW LINAC) that can be tuned at multiple different energy levels to provide a highly stable, highly efficient X-ray beam. At each energy level, the X-ray beam can be tuned by changing the frequency and amplitude of radio frequency (RF) electromagnetic waves provided by a klystron and the number of electrons injected by the electron gun. An electromagnetic wave is also referred to herein as a carrier wave. The electromagnetic waves (i.e., carrier waves) accelerate electron bunches within an accelerator structure to generate an X-ray beam. Changing the frequency and amplitude of the electromagnetic waves enables the electron bunches to, on average, remain at the crest of the electromagnetic waves for multiple different energy levels. This can reduce susceptibility of the TW LINAC to jitter of the amplitude and frequency of the RF electromagnetic waves, jitter of the electron gun high voltage and temperature fluctuations of the accelerator structure, and can maximize efficiency at each energy level.

6.1 Multi-Energy Traveling Wave Linear Accelerator Architecture

Figure 1:
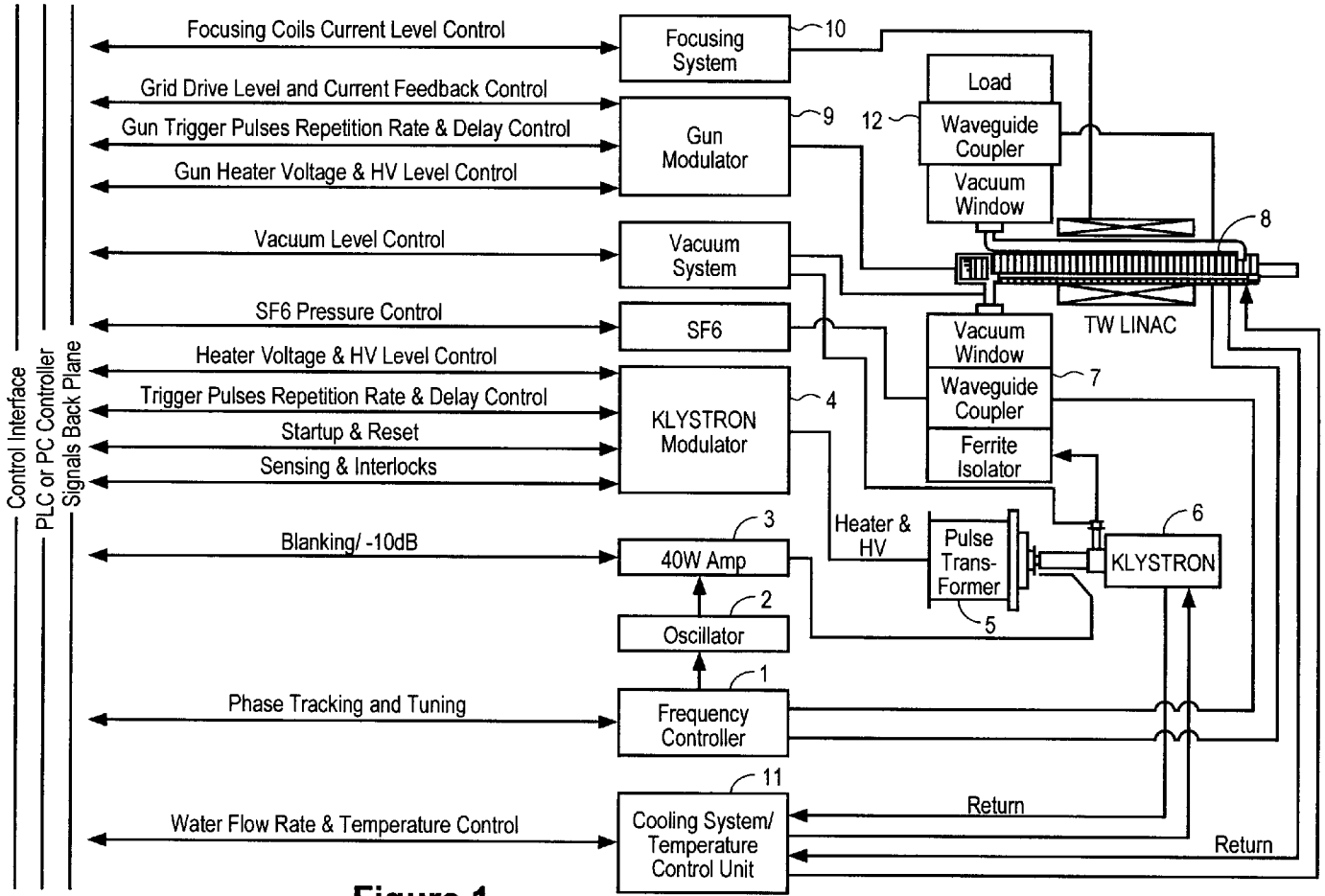
FIG. 1 illustrates a block diagram of a multi-energy traveling wave linear accelerator.

FIG. 1 illustrates a block diagram of an exemplary multi-energy traveling wave linear accelerator, in accordance with one embodiment of the present invention. The illustrated traveling wave linear accelerator (TW LINAC) includes a control interface through which a user can adjust settings, control operation, etc. of the TW LINAC. The control interface communicates with a programmable logic controller (PLC) and/or a personal computer (PC) that is connected to a signal backplane. The signal backplane provides control signals to multiple different components of the TW LINAC based on instructions received from the PLC, PC and/or control interface.

A frequency controller 1 receives phase tracking and tuning control information from the signal backplane. The frequency controller 1 can be configured to operate at a single frequency setting or to alternate between two or more different frequency settings. For example, the frequency controller 1 can be configured to alternate between a frequency of 9290 Hz and a frequency of 9291 Hz, 400 times per second. Alternatively, the frequency controller 1 may be configured to alternate between more than two different frequencies. In an example, based on the comparison of the measured phase shift of the frequency through the TW LINAC on the previous pulse of the same energy with the set point for energy of the next pulse, the frequency controller 1 adjusts settings of an oscillator 2. By modifying the frequency of the RF signal generated by the oscillator 2, the frequency controller 1 can change the frequency of electromagnetic waves (carrier waves) produced by a klystron 6 on a pulse by pulse basis. Frequency shifts on the order of one or a few parts in 10,000 can be achieved.

The frequency controller 1 may be a phase detection frequency controller, and can use phase vs. frequency response to establish a correct frequency setting. The frequency controller 1, by monitoring and correcting the phase shift from the input to the output of the accelerator, can correct for medium and slow drifts in either the RF frequency or the temperature of the accelerator structure 8. The frequency controller 1 can operate as an automatic frequency control (AFC) system. In an example, the frequency controller 1 can be a multi-frequency controller, and can operate at a set point for each of several different frequencies, with each frequency being associated with each different energy. The frequency controller, including the AFC, is discussed further in Section 6.3 below.

The oscillator 2 generates an RF signal having a frequency that is provided by the frequency controller 1. The oscillator 2 is a stable low level tunable RF source that can shift in frequency rapidly (e.g., between pulses generated by the klystron modulator 4). The oscillator 2 can generate an RF signal at the milliwatt level. The RF signal is amplified by an amplifier 3 (e.g., a 40 Watt amplifier), and supplied to a klystron 6. The amplifier 3 can be a solid state amplifier or a traveling wave tube (TWT) amplifier, and can amplify the received RF signal to a level required for input to the klystron 6. In an example, the amplifier 3 can be configured to change the output power level, on a pulse to pulse basis, to the level appropriate for the energy of an upcoming LINAC pulse. Alternatively, the klystron modulator 4 could deliver different high voltage pulses to the klystron 6 for each beam energy required.

A klystron modulator 4 receives heater and high voltage (HV) level control, trigger pulse and delay control, startup and reset, and sensing and interlock signals from the signal backplane. The klystron modulator 4 is a capable of generating high peak power pulses to a pulse transformer. The effective output power of the klystron modulator 4 is the power of the flat-top portion of the high voltage output pulse. The klystron modulator 4 can be configured to generate a new pulse at each frequency change in the frequency controller 1. For example, a first pulse may be generated when the frequency controller 1 causes the oscillator 2 to generate an RF signal having a first frequency, a second pulse may be generated when the frequency controller 1 causes the oscillator 2 to generate an RF signal having a second frequency, a third pulse may be generated when the frequency controller 1 causes the oscillator 2 to generate an RF signal having the first frequency, and so on.

The klystron modulator 4 drives energy into a pulse transformer 5 in the form of repeated high energy approximately square wave pulses. The pulse transformer 5 increases the received pulses into higher energy voltage pulses with a medium to high step-up ratio. The transformed pulses are applied to the klystron 6 for the generation of high energy microwave pulses. The rise time of the output pulse of the klystron modulator 4 is dominated by the rise time of the pulse transformer 5, and therefore the pulse transformer 5 is configured to have a fast rise time to approximate square waves.

The klystron 6 is a linear-beam vacuum tube that generates high power electromagnetic waves (carrier waves) based on the received modulator pulses and the received oscillator radio frequency (RF) signal. The klystron 6 provides the driving force that powers the linear accelerator. The klystron 6 coherently amplifies the input RF signal to output high power electromagnetic waves that have precisely controlled amplitude, frequency and input to output phase in the TW LINAC accelerator structure. The klystron 6 operates under pulsed conditions, which enables the klystron 6 to function using a smaller power source and require less cooling as compared to a continuous power device. The klystron 6 typically has a band width on the order of one percent or more.

The klystron 6 is an amplifier, therefore, the output RF signal generated by the klystron 6 has the same frequency as the low power RF signal input to the klystron 6. Thus, changing the frequency of the high power RF electromagnetic wave used to drive the LINAC can be achieved simply by changing the frequency of the low power RF signal used to drive the klystron 6. This can be easily performed between pulses with low power solid state electronics. Similarly, the output power of the electromagnetic wave from the klystron can be changed from pulse to pulse by just changing the power out of the amplifier 3.

A waveguide 7 couples the klystron 6 to an input of an accelerator structure 8 of the TW LINAC. The waveguide 7 includes a waveguide coupler and a vacuum window. The waveguide 7 carries high powered electromagnetic waves (carrier waves) generated by the klystron 6 to the accelerator structure 8. The waveguide coupler of waveguide 7 can sample a portion of the electromagnetic wave power to the input of the LINAC. A waveguide 12 that includes a waveguide coupler and a vacuum window couples the output of the accelerator structure 8 to the RF load. The waveguide coupler of waveguide 12 can sample a portion of the electromagnetic wave power to the output of the LINAC. A phase comparator of frequency controller 1 can be used to compare a signal from the waveguide coupler of waveguide 7 to a signal from the waveguide coupler of waveguide 12 to determine the phase shift of the electromagnetic wave through accelerator structure 8. The frequency controller 1 uses the phase shift of the electromagnetic wave to determine the frequency correction to be applied at the klystron, if any. Waveguide 7 or waveguide 12 can be a rectangular or circular metallic pipe that is configured to optimally guide waves in the frequencies that are used to accelerate electrons within the LINAC without significant loss in intensity. The metallic pipe can be a low-Z, high conductivity, material such as copper. To provide the highest field gradient possible with near maximum input power, the waveguide coupler can be filled with $SF_6$ gas. Alternatively, the waveguide can be evacuated.

The vacuum window permits the high power electromagnetic waves to enter the accelerator structure 8 while separating the evacuated interior of the accelerator structure 8 from its gas filled or evacuated exterior.

A gun modulator 9 controls an electron gun (not shown) that fires electrons into the accelerator structure 8. The gun modulator 9 receives grid drive level and current feedback control signal information from the signal backplane. The gun modulator 9 further receives gun trigger pulses and delay control pulse and gun heater voltage and HV level control from the signal backplane. The gun modulator 9 controls the electron gun by instructing it when and how to fire (e.g., including repetition rate and grid drive level to use). The gun modulator 9 can cause the electron gun to fire the electrons at a pulse repetition rate that corresponds to the pulse repetition rate of the high power electromagnetic waves (carrier waves) supplied by the klystron 6.

An example electron gun includes an anode, a grid, a cathode and a filament. The filament is heated to cause the cathode to release electrons, which are accelerated away from the cathode and towards the anode at high speed. The anode can focus the stream of emitted electrons into a beam of a controlled diameter. The grid can be positioned between the anode and the cathode.

The electron gun is followed by a buncher that is located after the electron gun and is typically integral with the accelerating structure. In one embodiment, the buncher is composed of the first few cells of the accelerating structure. The buncher packs the electrons fired by the electron gun into bunches and produces an initial acceleration. Bunching is achieved because the electrons receive more energy from the electromagnetic wave (more acceleration) depending on how near they are to the crest of the electromagnetic wave. Therefore, electrons riding higher on the electromagnetic wave catch up to slower electrons that are riding lower on the electromagnetic wave. The buncher applies the high power electromagnetic waves provided by the klystron 6 to the electron bunch to achieve electron bunching and the initial acceleration.

High power electromagnetic waves are injected into the accelerator structure 8 from the klystron 6 via the waveguide 7. Electrons to be accelerated are injected into the accelerator structure 8 by the electron gun. The electrons enter the accelerator structure 8 and are typically bunched in the first few cells of the accelerator structure 8 (which may comprise the buncher). The accelerator structure 8 is a vacuum tube that includes a sequence of tuned cavities separated by irises. The tuned cavities of the accelerator structure 8 are bounded by conducting materials such as copper to keep the RF energy of the high power electromagnetic waves from radiating away from the accelerator structure 8.

The tuned cavities are configured to manage the distribution of electromagnetic fields within the accelerator structure 8 and distribution of the electrons within the electron beam. The high power electromagnetic waves travel at approximately the same speed as the bunched electrons so that the electrons experience an accelerating electric field continuously. In the first portion of the TW LINAC, each successive cavity is longer than its predecessor to account for the increasing particle speed. Typically, after the first dozen or so cells the electrons reach about 98% of the velocity of light and the rest of the cells are all the same length. The basic design criterion is that the phase velocity of the electromagnetic waves matches the particle velocity at the locations of the accelerator structure 8 where acceleration occurs.

Once the electron beam has been accelerated by the accelerator structure 8, it can be directed at a target, such as a tungsten target, that is located at the end of the accelerator structure 8. The bombardment of the target by the electron beam generates a beam of x-rays (discussed in Section 6.4 below). The electrons can be accelerated to different energies before they strike a target. In an interleaving operation, the electrons can be alternately accelerated to two different output energies, e.g., to 6 mega electron volts (MeV)[1] and to 9 MeV. Alternately, the electrons can be accelerated to different energies.

One electron volt equals $1.602\times10^{-19}$ joule. Therefore, 6 MeV=$9.612\times10^{-13}$ joule.

To achieve a light weight and compact size, the TW LINAC may operate in the X-band (e.g., at an RF frequency between 8 GHz and 12.4 GHz). The high operating frequency, relative to a conventional S-band LINAC, reduces the length of the accelerator structure 8 by approximately a factor of three, for a given number of accelerating cavities, with a concomitant reduction in mass and weight. As a result, all of the essential components of the TW LINAC may be packaged in a relatively compact assembly. Alternatively, the TW LINAC may operate in the S-band. Such a TW LINAC requires a larger assembly, but can provide a higher energy X-ray beam (e.g., up to about 18 MeV) with commercially available high power electromagnetic wave sources.

A focusing system 10 controls powerful electromagnets that surround the accelerator structure 8. The focusing system 10 receives a current level control from the signal backplane, and controls a current level of focusing coils to focus an electron beam that travels through the accelerator structure 8. The focusing system 10 is designed to focus the beam to concentrate the electrons to a specified diameter beam that is able to strike a small area of the target. The beam can be focused and aligned by controlling the current that is supplied to the electromagnet. In an example, the focusing current is not changed between pulses, and the current is maintained at a value which allows the electromagnet to substantially focus the beam for each of the different energies of operation.

A sulfur hexafluoride ($SF_6$) controller controls an amount (e.g., at a specified pressure) of $SF_6$ gas that can be pumped into the waveguide. The $SF_6$ controller receives pressure control information from the backplane and uses the received information to control the pressure of $SF_6$ gas that is supplied to the waveguide. $SF_6$ gas is a strong electronegative molecule, giving it an affinity for free electrons. Therefore, the $SF_6$ gas is used as a dielectric gas and insulating material, and can be provided to waveguide 7 and waveguide 12 to quench arcs that might otherwise occur. The $SF_6$ gas increases the amount of peak power that can be transmitted through the waveguide 7, and can increase the voltage rating of the TW LINAC.

A vacuum system (e.g., an ion pump vacuum system) can be used to maintain a vacuum in both the klystron 6 and the accelerator structure 8. A vacuum system also can be used to generate a vacuum in portions of the waveguide 7. In air, intense electric and magnetic fields cause arcing, which destroys the microwaves, and which can damage the klystron, waveguide or accelerator structure. Additionally, within the accelerator structure 8, any beams that collide with air molecules are knocked out of the beam bunch and lost. Evacuating the chambers prevents or minimizes such occurrences.

The vacuum system may report current vacuum levels (pressure) to the signal backplane. If pressure of the klystron 6 or accelerator structure 8 exceed a pressure threshold, the vacuum system may transmit a command to the signal backplane to turn off the klystron 6 until an acceptable vacuum level is reached.

Many components of the TW LINAC can generate heat. Heat can be generated, for example, due to the electromagnetic wave power loss on the inner walls of the accelerator, by the electron bombardment of the target at the end of the accelerator structure 8, and by the klystron 6. Since an increase in temperature causes metal to expand, temperature changes affect the size and shape of cavities within the accelerator structure, the klystron, the waveguide, etc. This can cause the frequency at which the wave is synchronous with the beam to change with the temperature. The proper operation of the accelerator requires careful maintenance of the cavity synchronous frequency to the passage of beam bunches. Therefore, a cooling system 11 is used to maintain a constant temperature and minimize shifts in the synchronous frequency.

The cooling system 11 circulates water or other coolant to regions that need to be cooled, such as the klystron 6 and the accelerator structure 8. Through the signal backplane, the cooling system 11 receives water flow rate and temperature control information. The cooling system 11 can be used to monitor the temperature of the klystron 6 and the accelerator structure 8, and can be configured to maintain a constant temperature in these components. However, the temperature of the metal of the accelerator structure and the klystron may rise as much as 10 degrees when the LINAC is operated at a high repetition rate, which can contribute to the drift in the electromagnetic wave. The frequency controller can be used to compensate for the effect of the drift.

Figure 2:
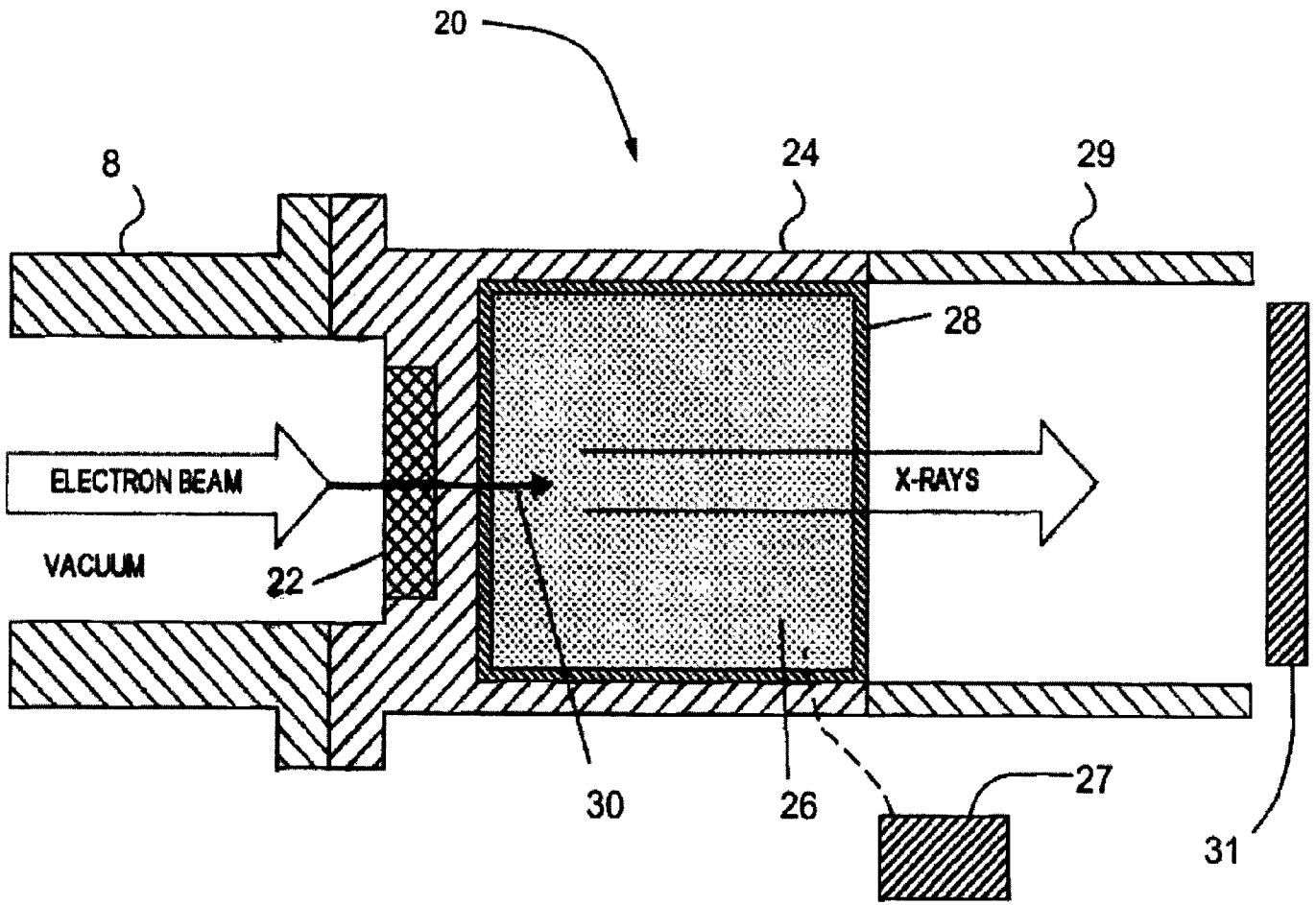
FIG. 2 illustrates a cross-section of a target structure coupled to the accelerator structure.

FIG. 2 illustrates a cross-section of a target structure 20 coupled to the accelerator structure 8 (partially shown). The target structure 20 includes a target 22 to perform the principal conversion of electron energy to x-rays. The target 22 may be, for example, an alloy of tungsten and rhenium, where the tungsten is the principle source of x-rays and the rhenium provides thermal and electrical conductivity. In general, the target 22 may include one or more target materials having an atomic number approximately greater than or equal to 70 to provide efficient x-ray generation. In an example, the x-ray target can include a low-Z material such as but not limited to copper, which can avoid or minimize generation of neutrons when bombarded by the output electrons.

When electrons from the electron beam enter the target, they give up energy in the form of heat and x-rays (photons), and lose velocity. In operation, an accelerated electron beam impinges on the target, generating Bremsstrahlung and k-shell x-rays (see Section 6.4 below).

The target 22 may be mounted in a metallic holder 24, which may be a good thermal and electrical conductor, such as copper. The holder 24 may include an electron collector 26 to collect electrons that are not stopped within the target 22 and/or that are generated within the target 22. The collector 26 may be a block of electron absorbing material such as a conductive graphite based compound. In general, the collector 26 may be made of one or more materials with an atomic number approximately less than or equal to 6 to provide both electron absorption and transparency to x-rays generated by the target 22. The collector 26 may be electrically isolated from a holder by an insulating layer 28 (e.g., a layer of anodized aluminum). In an example, the collector 26 is a heavily anodized aluminum slug.

A collimator 29 can be attached to the target structure. The collimator 29 shapes the X-ray beam into an appropriate shape. For example, if the TW LINAC is being used as an X-ray source for a cargo inspection system, the collimator 29 may form the beam into a fan shape. The X-ray beam may then penetrate a target (e.g., a cargo container), and a detector at an opposite end of the target may receive X-rays that have not been absorbed or scattered. The received X-rays may be used to determine properties of the target (e.g., contents of a cargo container).

A x-ray intensity monitor 31 can be used to monitor the yield of the x-ray during operation (see FIG. 2). A non-limiting example of an x-ray intensity monitor 31 is an ion chamber. The x-ray intensity monitor can be positioned at or near the x-ray source, for example, facing the target. In one embodiment, based on measurements from the x-ray intensity monitor 31 from one pulse of the LINAC to another, the frequency controller can transmit a signal to the one or more oscillators to cause the electromagnetic wave source to generate an electromagnetic wave at a frequency and amplitude to maximize the yield of x-ray at an energy.

The frequency controller 1 can be interfaced with the x-ray intensity monitor 31. The frequency controller 1 can be used to monitor the measurements from the x-ray intensity monitor (which provide an indication of the x-ray yield) and use that information to provide a signal to the oscillator. The oscillator can tune the electromagnetic wave source to generate an electromagnetic wave at a frequency based on the signal from the frequency controller. In an embodiment, the frequency controller be configured to compare a measurement from the x-ray intensity monitor that indicates the yield of the first beam of x-rays emitted in a desired range of x-ray energies to a measurement from the x-ray intensity monitor that indicates the yield of the second beam of x-rays at that range of x-ray energies. The second beam of x-rays can be generated using a set of electrons that is accelerated in the accelerator structure by an electromagnetic wave that has about the same amplitude as that used in the generation of the first beam of x-rays. For example, the electromagnetic waves can have about the same magnitude if they differ by less than about 0.1%, less than about 1%, less that about 2%, less than about 5% in magnitude, less than about 10% in magnitude, or more. The frequency of the electromagnetic wave delivered to the LINAC for generating the second beam of x-rays can differ in magnitude from the frequency of the electromagnetic wave delivered to the LINAC for generating the first beam of x-rays by a small amount ($\delta f$). For example, $\delta f$ be a difference on the order of about one or a few parts in 10,000 of a frequency in kHz. In some embodiments, $\delta f$ can be a difference on the order of about 0.000001 MHz or more, about 0.00001 MHz or more, about 0.001 MHz or more, about 0.01 MHz or more, about 0.03 MHz or more, about 0.05 MHz or more, about 0.08 MHz or more, about 0.1 MHz or more, or about 0.15 MHz or more. The frequency controller can transmit a signal to the oscillator so that the oscillator causes the electromagnetic wave source to generate a subsequent electromagnetic wave at a frequency to maximize the yield of a x-rays in a subsequent operation of the LINAC.

The frequency controller can tune the frequency of the electromagnetic wave by monitoring both (i) the phase shift of the electromagnetic wave from the input to the output of the accelerator structure and (ii) the dose from the x-ray intensity monitor.

In another embodiment, the frequency controller can also be interfaced with an electron energy spectrum monitor 27 (see FIG. 2). A non-limiting example of an electron energy spectrum monitor is an electron current monitor. For example, an electron current monitor can be configured to measure the current reaching the electron current collector 26 in the target assembly (see FIG. 2). The electron energy spectrum monitor can be positioned near the output of the accelerator structure. The electron energy spectrum monitor can be used to monitor the electron current of the output of electrons for a given pulse of the LINAC. Based on the measurements from the electron energy spectrum monitor, the frequency controller transmits a signal to the oscillator so that the oscillator tunes the electromagnetic wave source to the desired frequency. In this embodiment, the frequency controller can be configured to compare an indication of a first energy spectrum of a first output of electrons from the output of the accelerator structure to an indication of a second energy spectrum of a second output of electrons from the output of the accelerator structure, and transmit a signal to the oscillator based on the comparison. For example, the frequency controller can be configured to compare a first electron current of the first output of electrons from one pulse of the LINAC to a second electron current of the second output of electrons from another pulse. The second output of electrons can be generated using an electromagnetic wave that has about the same amplitude as that used to generate the first output of electrons. For example, the electromagnetic waves can have about the same magnitude if they differ by less than about 0.1%, less than about 1%, less that about 2%, less than about 5% in magnitude, less than about 10% in magnitude, or more. The frequency of the electromagnetic wave delivered to the LINAC for generating the second output of electrons can differ in magnitude from the frequency of the electromagnetic wave delivered to the LINAC for generating the first output of electrons by a small amount (δf). For example, δf be a difference on the order of about one or a few parts in 10,000 of a frequency in kHz. In some embodiments, δf can be a difference on the order of about 0.000001 MHz or more, about 0.00001 MHz or more, about 0.001 MHz or more, about 0.01 MHz or more, about 0.03 MHz or more, about 0.05 MHz or more, about 0.08 MHz or more, about 0.1 MHz or more, or about 0.15 MHz or more. Based on the signal from the frequency controller, the oscillator can cause the electromagnetic wave source to generate a subsequent electromagnetic wave at a frequency to stabilize the energy of a subsequent output of electrons.

In an embodiment, the frequency controller can tune the frequency of the electromagnetic wave by monitoring both (i) the phase shift of the electromagnetic wave from the input and the output of the accelerator structure and (ii) the electron current of the output of electrons.

In yet another embodiment, the frequency controller can tune the electromagnetic wave source primarily by monitoring the phase shift of the electromagnetic wave from the input and the output of the accelerator structure, and as a secondary measure can monitor the doses of the x-ray intensity monitor and the electron current of the output of electrons.

The frequency controller can be configured to tune the frequency of the electromagnetic wave source, based on the monitoring of the phase, x-ray yield, and/or energy spectrum of the output electrons from pulses of the LINAC as described herein, in an iterative process. That is, the frequency controller can be configured to tune the electromagnetic wave source in an iterative process so that, with each subsequent pulse of the LINAC for a given energy of operation, the yield of x-rays is further improved until it reaches the maximum or is maintained at the maximum, or the stability of the energy spectrum of the output of electrons is further increased or maintained.

6.2 Multi-Energy Traveling Wave Linear Accelerator Operation Theory

In a one energy LINAC, the accelerator structure 8 is configured such that the electron bunch rides at the crest of the high energy electromagnetic waves throughout the accelerator structure 8, except in the first few cells of the accelerator structure 8 that comprise the buncher. This can be accomplished by ensuring that the electric field of the electromagnetic waves remains in phase with the electron bunches that are being accelerated. An electron bunch that rides at the crest of the electromagnetic wave receives more energy than an electron bunch that rides off the crest, which increases efficiency of the LINAC. Moreover, the crest of the electromagnetic wave has a slope of zero. Therefore, if jitter occurs to cause the electron bunch to move off of the crest of the wave, the amount of energy imparted to the electron bunch changes only by a very small amount. For these reasons, it is desirable to have the electron bunch ride the crest of the electromagnetic waves.

Figure 3:
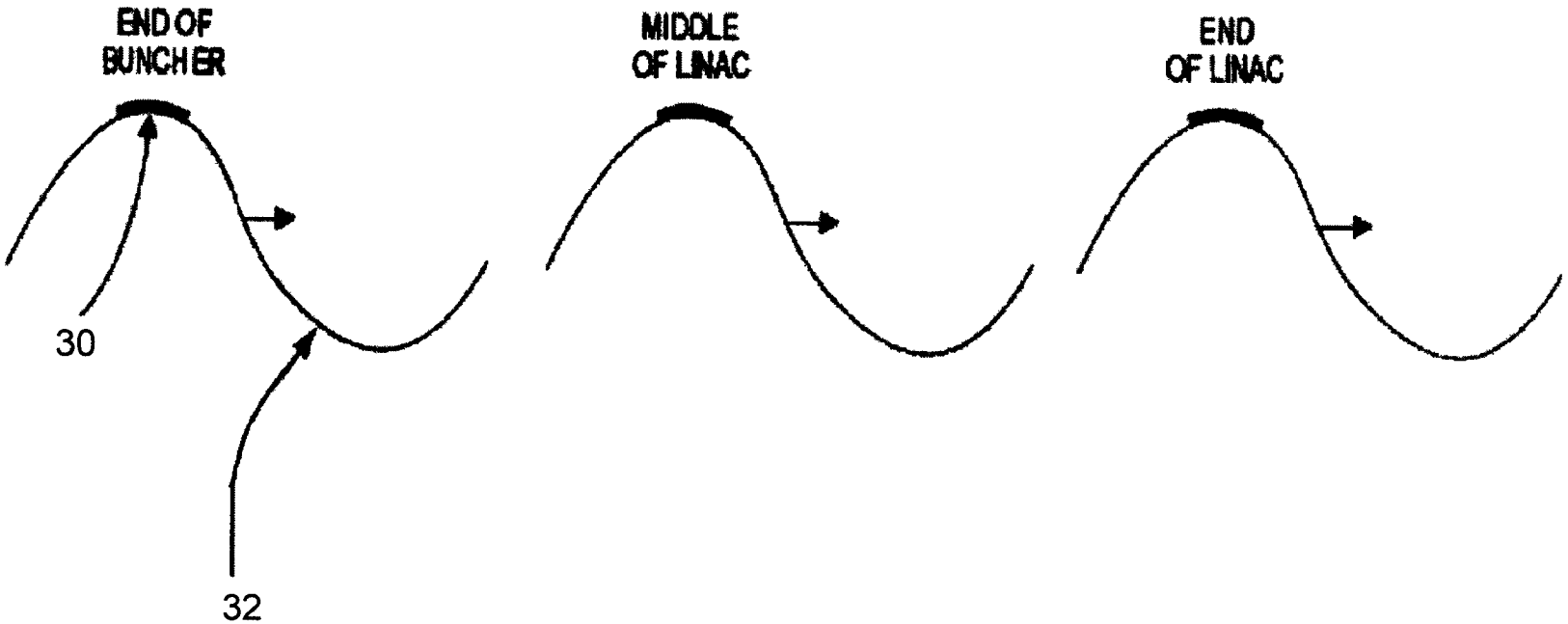
FIG. 3 illustrates an electron bunch riding an electromagnetic wave at three different regions in an accelerator structure.

FIG. 3 illustrates an electron bunch 30 riding an electromagnetic wave 32 (also referred to as a carrier wave) at the beginning of the accelerator structure (just after exiting the buncher), at the middle of the accelerator structure, and at the end of the accelerator structure (just before striking the target). FIG. 3 illustrates a higher energy operation of the LINAC, where electron bunch 30 can ride substantially at the crest of the electromagnetic wave 32 at each region of the accelerator structure (substantially synchronous).

In a multi-energy LINAC, the accelerator structure is typically configured such that at the higher energy operation the electron bunches 30 ride at the crests of the high energy electromagnetic waves 32, as is shown in FIG. 3. However, to impart less energy on the electron beam for the lower energy operation, the strength (amplitude) of the electromagnetic wave can be reduced by reducing the output power of the klystron 6 (e.g., by reducing the input drive power to the klystron 6 or by reducing the klystron high voltage pulse). As another example way to impart less energy on the electron beam for the lower energy operation, the acceleration imparted by the electromagnetic wave also can be reduced by increasing the beam current from the electron gun in an effect referred to as beam loading (described in Section 6.3 below). The lower strength electromagnetic wave accelerates the electron bunches at a slower rate than the higher strength electromagnetic waves. Therefore, when the RF field amplitude is lowered to lower the energy of the X-ray beam, the electron bunches gain energy less rapidly in the buncher and so end up behind the crest of the wave at the end of the buncher. This causes the electron bunches to fall behind the crest of the waves by the end of the buncher region of the accelerator structure. If the RF frequency is the same for the low energy level as for the high energy level, the bunch will stay behind the crest in the accelerator structure, resulting in a broad, undesirable, energy spectrum.

When the electron bunch does not travel at the crest of the electromagnetic wave, the efficiency of the LINAC is reduced, and therefore greater power is required than would otherwise be necessary to generate the lower power X-ray beam. More importantly, since the electron bunch is not at the crest of the wave, any jitter can cause the electron bunch to move up or down on the electromagnetic sine wave. Thus, the energy of the X-ray beam will fluctuate in response to phase fluctuations caused by jitter in the RF frequency and amplitude and variation in the accelerator structure temperature. This changes the amount of energy that is imparted to the electron bunch, which causes instability and reduces repeatability of the resultant X-ray beam.

Three typical sources of jitter include frequency jitter from the RF source, temperature variation from the accelerator structure and amplitude jitter from the RF source. All three sources of jitter can cause the electron bunch to move up or down on the electromagnetic sine wave. Additionally, amplitude jitter of the RF source also can cause jitter in the amplitude of the accelerating fields throughout the LINAC.

A standing wave LINAC has a fixed number of half wavelengths from one end of the accelerator structure to the other, equal to the number of resonant accelerating cavities. Therefore, the phase velocity of the electromagnetic waves cannot be changed in a standing wave LINAC. For the standing wave LINAC, when the frequency of the electromagnetic wave is changed, the electromagnetic wave moves off the resonance frequency of the accelerator structure, and the amplitude of the electromagnetic waves decreases. However, the phase velocity is still the same, and the accelerator structure still has the same number of half wavelengths. Therefore, the standing wave LINAC cannot be adjusted to cause the electron bunch to ride at the crest of the electromagnetic wave for multiple energy levels.

Traveling wave LINACS have the property that rather than having discrete modes (as in a standing wave LINAC), they have a continuous pass band in which the phase velocity (velocity of the electromagnetic wave) varies continuously with varying frequency. In a TW LINAC the phase velocity of the electromagnetic wave can be changed with the change in frequency.

Figure 4:
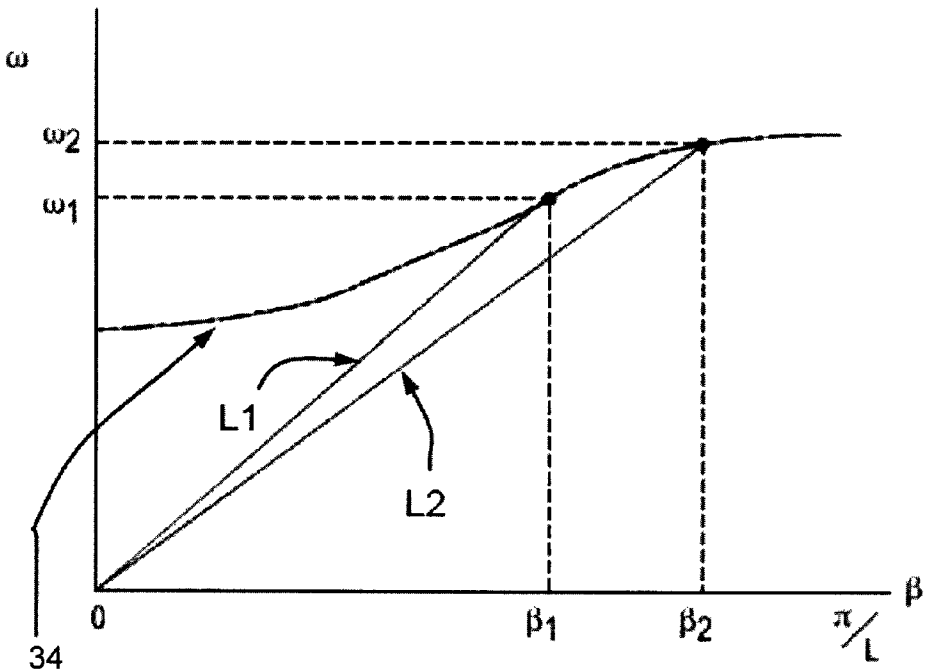
FIG. 4 illustrates a dispersion curve for an exemplary TW LINAC after an electron beam has passed through the buncher.

FIG. 4 illustrates a dispersion curve 34 for an exemplary TW LINAC. The dispersion curve 34 in FIG. 4 graphs angular frequency ($\omega \equiv \pi f$, wherein f is the frequency of the electromagnetic wave in the accelerator structure) vs. the propagation constant ($\beta \equiv 2\pi/\lambda$, where $\lambda$ is the wavelength of the electromagnetic wave in the accelerator structure) for the exemplary TW LINAC. The propagation constant, $\beta$, is the phase shift of the RF electromagnetic wave per unit distance along the Z axis of the TW LINAC. The phase velocity of an electromagnetic wave in the TW LINAC is equal to the slope, $\omega/\beta$, of the line from the origin to the operating point, $\omega/\beta$, which is equal to the frequency times the wavelength of the electromagnetic wave ($f\lambda$). As shown, the phase velocity of the electromagnetic wave varies continuously with varying frequency. The group velocity (the velocity with which a pulse of the electromagnetic wave propagates) is given by $d\omega/d\beta$, the slope of the dispersion curve. The change of phase, $\delta\phi(z)$, at a longitudinal position z in the TW LINAC caused by a change of angular frequency $\delta\omega$, is given by the equation:

$$\delta\phi(z)=\delta\omega\int dz/(d\omega/d\beta)=\delta\omega\int dz/v_g=\delta\omega t_f(z) \quad (1)$$

where $t_f(z)$ is the filling time from the beginning of the LINAC to the position z.

It is important to realize that in general for LINACs the dispersion curve, and therefore both the phase velocity and the group velocity, can vary from cell to cell. In the TW LINAC used as an example here, for the maximum energy operation most of the LINAC has a constant phase velocity equal to the velocity of light. However, the structure is designed to have an approximately constant gradient, which means that the group velocity decreases approximately linearly with distance along the LINAC. Therefore, when the frequency is changed (raised) for operation at the lower energy level (e.g., at 6 MeV), to achieve a maximum possible energy the phase velocity is no longer constant during the portion of acceleration at which the electrons travel at approximately the speed of light.

As the angular frequency of an electromagnetic wave is increased in the TW LINAC, the phase velocity of the electromagnetic wave is decreased. Thus, if the angular frequency of an electromagnetic wave used to generate a high energy electron beam is $\omega_1$ and the angular frequency of an electromagnetic wave used to generate a low energy electron beam is $\omega_2$, the slope of $\omega_1/\beta_1$ (L1) will be steeper than the slope of $\omega_2/\beta_2$ (L2). Accordingly, the phase velocity of the electromagnetic wave that generates the high energy X-ray beam is higher than the phase velocity of the electromagnetic wave that generates the low energy X-ray beam. The angular frequency of the electromagnetic wave used to generate the high energy X-ray beam can be chosen such that the phase velocity for the electromagnetic wave $\omega_1/(\beta_1)$ is approximately equal to the speed of light, through most of the LINAC.

Figure 5:
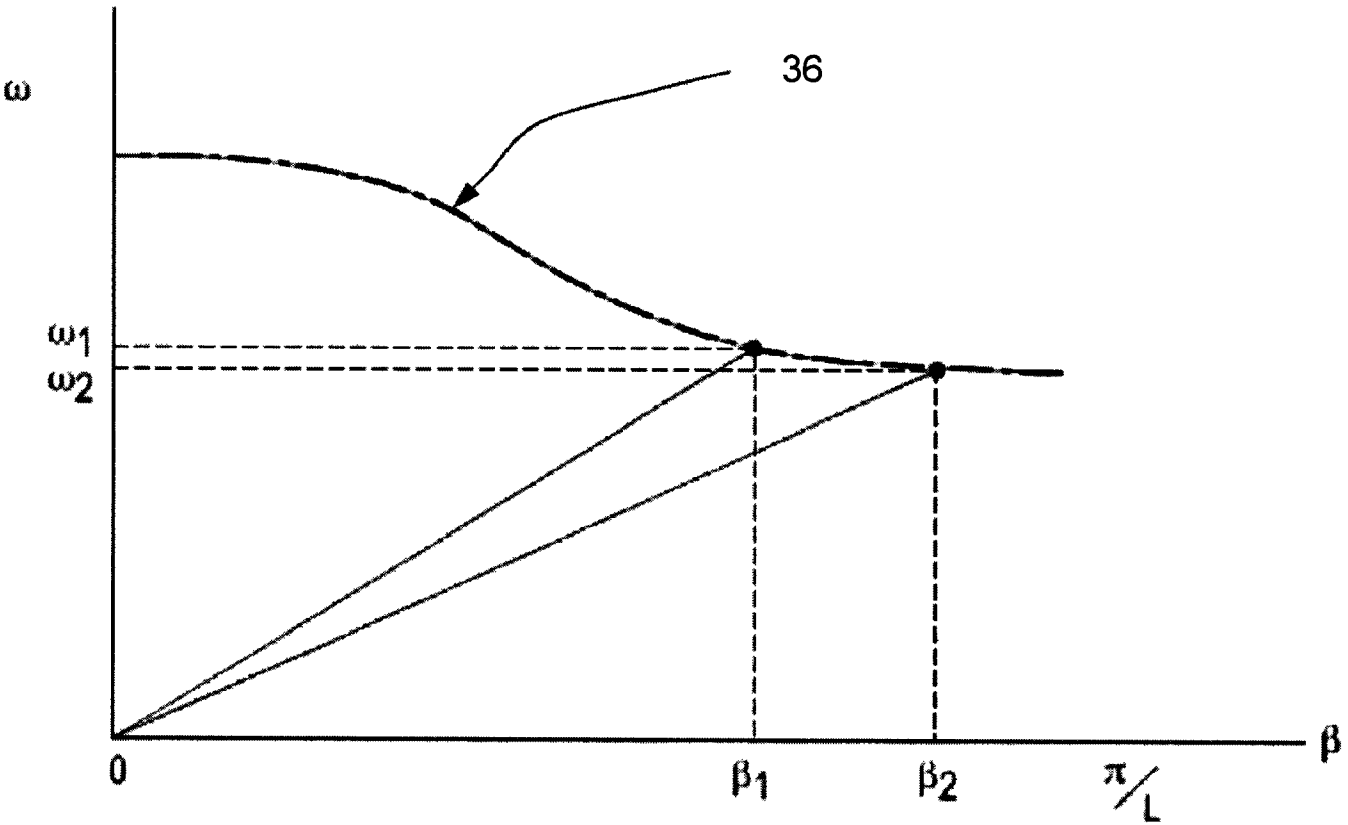
FIG. 5 illustrates a dispersion curve for a high efficiency magnetically coupled reentrant cavity traveling wave LINAC.

FIG. 5 illustrates a dispersion curve 36 for a high efficiency magnetically coupled reentrant cavity traveling wave LINAC. In the dispersion curve 36 in FIG. 5, the y-axis represents angular frequency and the x-axis represents propagation constants. As shown, in the high efficiency magnetically coupled reentry cavity TW LINAC configuration, the phase velocity varies continuously with changing frequency. However, the dispersion curve 36 of FIG. 5 shows a different relationship between angular frequency and phase velocity than is shown in the dispersion curve 34 of FIG. 4. For example, in the dispersion curve 36 of FIG. 5, angular frequency associated with the high energy electron beam is higher than the angular frequency associated with the low energy electron beam. This is in contrast to the dispersion curve 34 of FIG. 4, in which the angular frequency associated with the high energy beam is lower than the angular frequency associated with the low energy electron beam. The relationship between angular frequency and phase velocity can differ from LINAC to LINAC, and therefore the specific angular frequencies that are used to tune a TW LINAC should be chosen based on the relationship between angular frequency and phase velocity for the TW LINAC that is being tuned. A magnetically coupled backward wave traveling wave constant gradient LINAC with nose cones operating near the $3\pi/4$ or $4\pi/5$ mode could have a shunt impedance and therefore efficiency as high as a cavity coupled standing wave accelerator.

In one embodiment, the phase velocity of the electromagnetic wave can be adjusted to cause the electron bunch to, on average, travel at the crest of the electromagnetic wave. Alternately, the phase velocity of the electromagnetic wave can be adjusted to cause the electron bunch to, on average, travel ahead of the crest of the electromagnetic wave. Adjustments to the phase velocity can be achieved for multiple different energy levels simply by changing the frequency of the electromagnetic wave to an appropriate level. Such an appropriate level can be determined based on the dispersion curves as shown in FIGS. 4 and 5. For example, the RF frequency of the electromagnetic wave can be raised to reduce the phase velocity of the wave so that the electron bunch moves faster than the wave and drifts up toward the crest as it travels through the accelerator. Changing the RF frequency of the TW LINAC is easy to do on a pulse to pulse basis if the RF source is a klystron 6, thus allowing interleaving of 2 or more energies at a high repetition rate. Frequency changes can also be made when other RF sources are used. This strategy will work for a wide energy range (e.g., including either the full single structure X-band or the full single structure S-band energy range).

Figure 6:
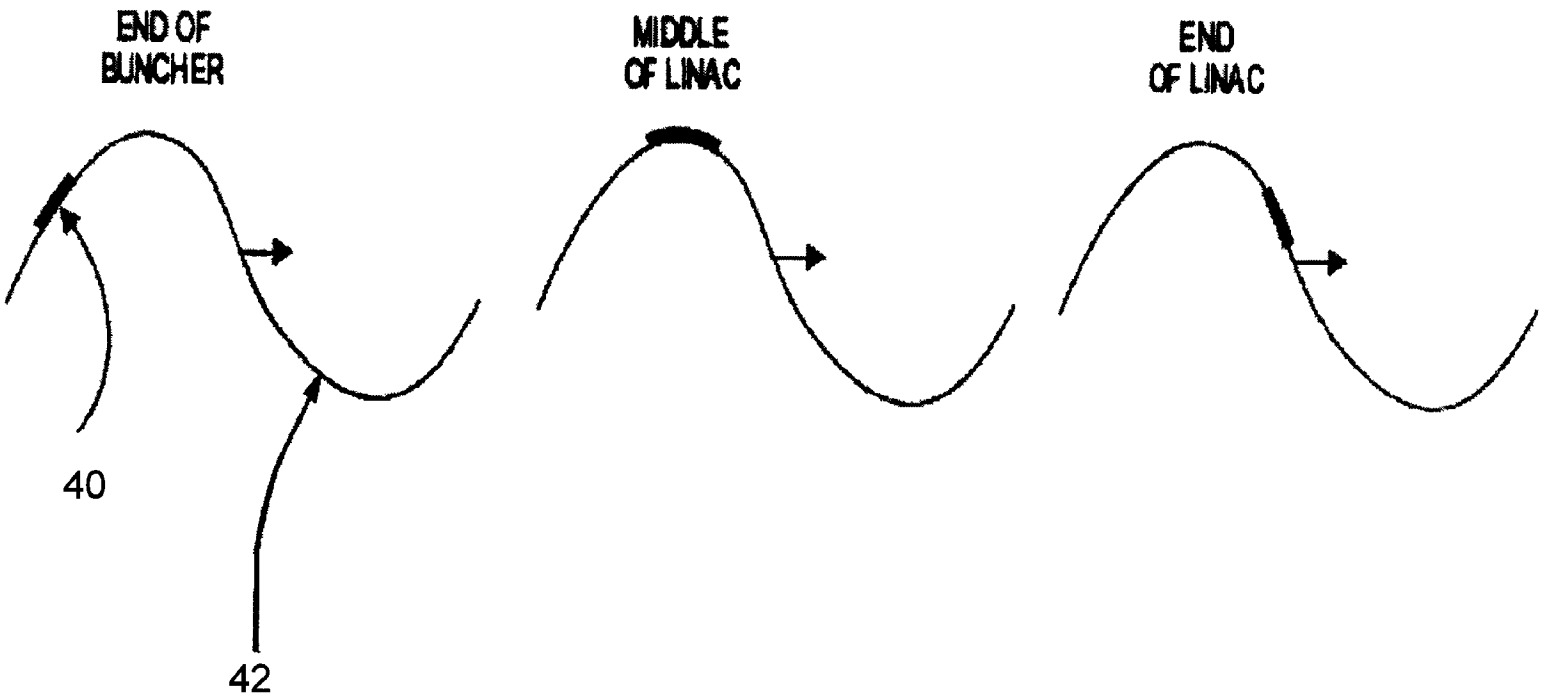
FIG. 6 illustrates an electron bunch riding an electromagnetic wave at three different regions in an accelerator structure of a TW LINAC.

FIG. 6 illustrates an electron bunch 40 riding an electromagnetic wave 42 at three different regions in an accelerator structure of a TW LINAC. FIG. 6 illustrates a lower energy operation of the LINAC. The electron bunch is depicted in FIG. 6 as substantially non-synchronous. The phase velocity of the electromagnetic wave has been adjusted such that the phase velocity is slower than the speed of the electron bunches (e.g., by increasing the RF frequency of the electromagnetic wave). In this lower energy beam operation, the electromagnetic fields can be smaller and the electron beam can be accelerated more slowly in the buncher region. When the electron bunch leaves the buncher region of the accelerator structure, it can be behind the crest of the electromagnetic wave. At approximately the middle of the accelerator structure, the electron bunch 40 is at the crest of the electromagnetic wave 42. At the end of the accelerator structure, the electron bunch 40 is ahead of the crest of the electromagnetic wave 42. On average, the electron bunch 40 is at the crest of the electromagnetic wave 42. Therefore, the electron bunch has an energy spectrum that is equivalent to an electron bunch that rides at the crest of a smaller amplitude electromagnetic wave throughout the accelerator structure. As a result, jitter does not cause a significant change in energy of the electron beam, and thus of a resulting X-ray beam.

In one embodiment, the phase velocity is adjusted so that the bunch is as far ahead of the crest at the end of the accelerator structure as it was behind the crest at the end of the buncher region of the accelerator structure for a given energy level. That way the electrons at the head of the bunch that gained more energy in the first half of the accelerator structure than the electrons at the tail of the bunch can gain less energy in the second half of the accelerator structure, and the two effects cancel to first order. Similarly, if the RF frequency jitters by a tiny amount causing the electron bunch to be farther behind at the beginning so that it gains less energy in the first half of the accelerator, it gains more energy in the second half, thus minimizing the energy jitter. The net effect of adjusting the frequency in this way is to make the energy distribution within the bunch at the end of the accelerator structure look as if the bunch rode on the crest of a smaller amplitude wave throughout the accelerator. This adjustment of the frequency can also maximize the energy gain (provide maximum X-ray yield) for the particular amplitude of the electromagnetic waves and reduce beam energy dependence on RF power level.

In another embodiment, the phase velocity is adjusted so that the bunch is further ahead of the crest at the end of the accelerator structure than it was behind the crest at the beginning of the accelerator structure for a given energy level. In other words, the RF frequency is raised to above the point where maximum X-ray yield can be obtained. Such an adjustment can address amplitude jitter introduced into the accelerating fields of the LINAC based on amplitude jitter in the RF source. It should be noted, however, that such an adjustment can cause a wider energy spectrum of the electron beam and the X-rays than adjusting the phase velocity so that the bunch is as far ahead of the crest at the end of the accelerator structure as it was behind the crest at the beginning of the accelerator structure for a given energy level.

As discussed above, frequency jitter from the RF source, temperature variation from the accelerator structure and amplitude jitter from the RF source all cause the electron bunch to move off the peak of the electromagnetic wave. However, amplitude jitter in the RF source also causes jitter in the amplitude of the accelerating fields throughout the LINAC. When the phase velocity (e.g., RF frequency) is adjusted to place the bunch, on average, ahead of the peak of the electromagnetic wave, the jitter in the amplitude of the accelerating fields can be ameliorated. The amplitude of the RF source can also be adjusted to ameliorate the amplitude jitter. Alternatively, or in addition, the pulse repetition rate of the LINAC can be changed to ameliorate the sources of jitter. For example, where there is a 180 Hz or 360 Hz ripple experienced by the TW LINAC when operating at 6 MeV, the pulse repetition rate can be changed from 400 pulses per second (pps) to 360 pps to alleviate jitter.

The jitter in the X-ray yield can be strikingly reduced by raising the RF frequency above the point where the maximum X-ray yield is obtained. This is optimum because when the frequency is raised above the maximum X-ray yield point it reduces the phase velocity of the electromagnetic wave and moves the bunch ahead of the accelerating crest on average in the LINAC. Then, if the RF amplitude jitters upward, the bunch moves farther ahead of the crest and the downward slope of the sine wave compensates for the increase in the accelerating fields in the LINAC. At some frequency the derivative of beam energy or X-ray yield with respect to RF power actually vanishes.

In one embodiment, the optimum RF frequency depends on the relative amplitude of the three sources of X-ray yield jitter. If the bunch is moved forward of the accelerating crest by just increasing the RF frequency, the beam energy and the X-ray yield will decrease. However, the bunch can be moved forward of the accelerator crest by increasing both the frequency and the amplitude of the RF drive, in a manner which keeps the energy approximately constant. In one embodiment, in the commissioning of a LINAC system, when a beam energy spectrometer is available, the function of power versus RF frequency above the maximum X-ray yield point, for each operating energy, is measured. Then an operator can find the point along this power versus frequency curve which gives the best stability and operate there.

The ability to change the phase velocity of the wave by just changing the frequency (or by changing the frequency and amplitude) enables the electron bunch to be at an optimum position relative to an electromagnetic wave for a given energy level. Therefore, stable X-rays can be generated at a range of energy levels. This causes the TW LINAC to be less susceptible to temperature changes, less susceptible to jitter in the frequency of the electromagnetic wave, and less susceptible to jitter in the amplitude of the electromagnetic wave.

6.3 Use Of A Frequency Controller In The Operation Of A Multi-Energy TW LINAC

In a multi-energy interleaving operation of a TW LINAC, a frequency controller can be used to measure the phase shift of the electromagnetic wave through the LINAC structure by comparing the phase of the electromagnetic wave at the input of the accelerator structure to the phase of the electromagnetic wave at the output of the accelerator structure. The frequency controller can transmit a signal to the oscillator to modify the frequency of the electromagnetic wave that is ultimately coupled into the accelerator structure based on the magnitude of the phase shift detected by the frequency controller. In a non-limiting example, the frequency controller can be an automatic frequency controller (AFC). The frequency controller can be a multi-frequency AFC, and can operate at a set point for each of several different frequencies, with each frequency being associated with each different energy. The frequency controller can be used to measure the RF phase of the electromagnetic wave at the output coupler relative to the RF phase of the electromagnetic wave at the input coupler. With this information, the frequency controller can be used to the frequency of the electromagnetic wave, to maintain the phase shift through the LINAC to a separate set point for each of the different energies of operation of the LINAC. The frequency controller can facilitate stable operation with quick settling during rapid switching of a multi-energy interleaved TW LINAC. For example, the frequency controller can be used to correct for the effect of rapid thermalization of the TW LINAC accelerator structure when the system is stepping from standby to full power, drifts in the temperature of the accelerator structure cooling water, or drifts in the frequency of the oscillator.

Figure 7:
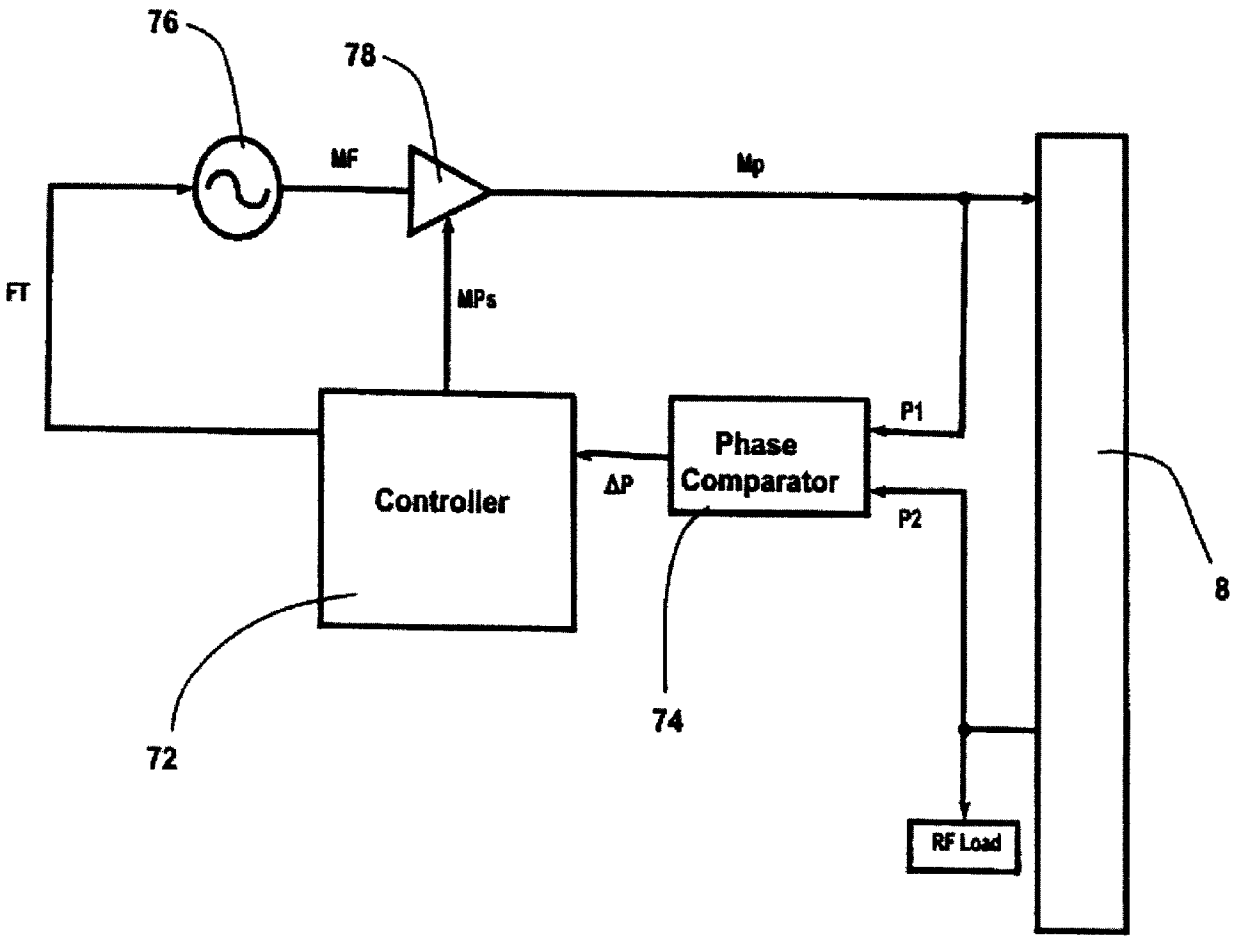
FIG. 7 illustrates a block diagram of a TW LINAC comprising a frequency controller.

FIG. 7 shows a block diagram of an embodiment of a TW LINAC comprising a frequency controller. In the illustration of FIG. 7, the frequency controller comprises a controller 72 and a phase comparator 74. In the example of FIG. 7, the phase comparator 74 compares the electromagnetic wave at the input of the accelerator structure 8 (P1) and at the output of the accelerator structure 8 (P2) and provides a measure of the phase shift ($\Delta P$) to the controller 72. The frequency controller can transmit a signal to the oscillator 76 to tune the frequency of the oscillator 76. As discussed above, the oscillator 76 can generate a signal having a frequency that is provided by the frequency controller, and the RF signal can be amplified by the amplifier 78 and supplied to a klystron (not shown). Thus, the signal from the frequency controller to the oscillator 76 can ultimately result in a modification of the frequency of the electromagnetic wave that is coupled into the accelerator structure, based on the magnitude of the phase shift detected by the frequency controller. The oscillator 76 can also generate a signal that results in a change of the frequency of the electromagnetic wave by an amount to change the operating energy of the LINAC in the tome interval between electromagnetic wave pulses an interleaving operation. The frequency controller is illustrated in FIG. 7 as comprising a controller 72 and a phase comparator 74 as separate units. However, in other embodiments, the frequency controller can comprise the controller and phase comparator as an integral unit.

Figure 8:
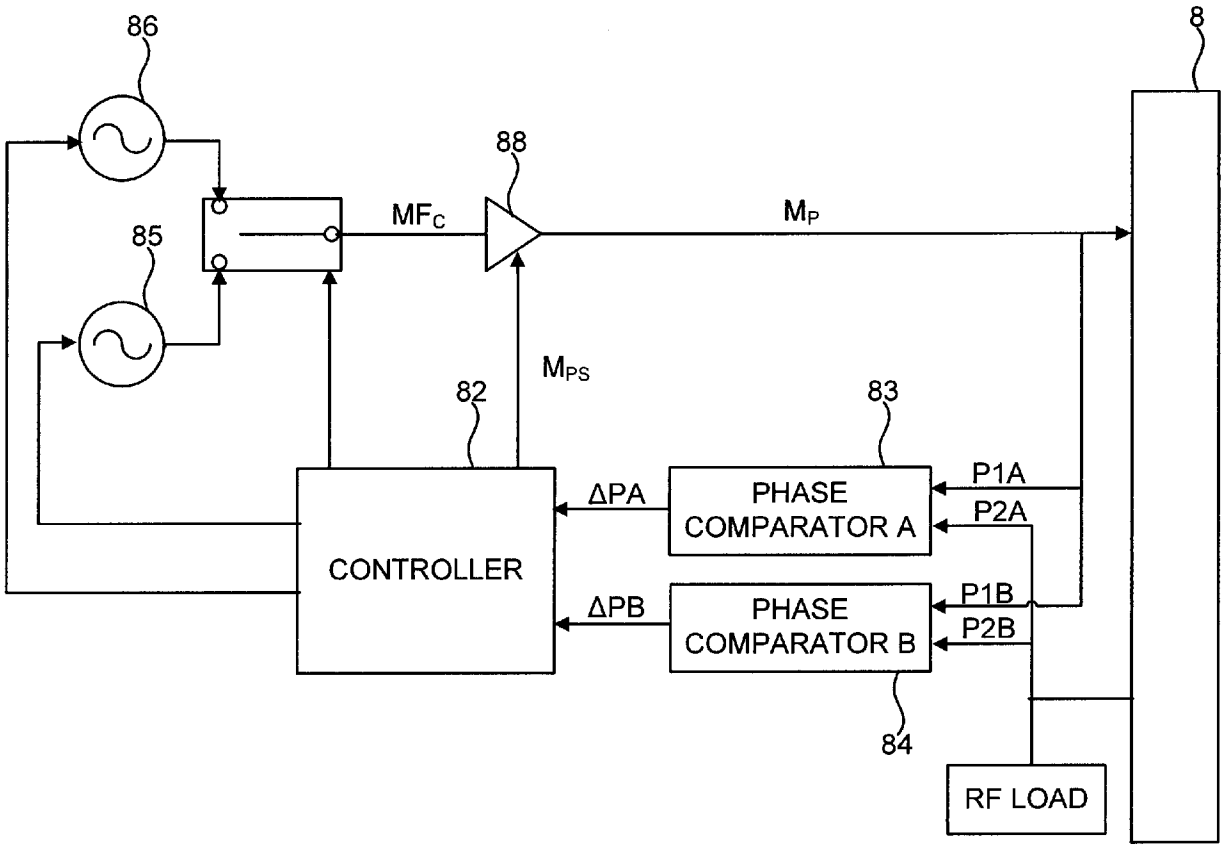
FIG. 8 illustrates another block diagram of a TW LINAC comprising a frequency controller.

FIG. 8 shows a block diagram of another embodiment of a TW LINAC comprising a frequency controller that can be used for a dual energy operation. In the illustration of FIG. 8, the frequency controller comprises a controller 82, and two phase comparators (phase comparator A 83 and phase comparator B 84) that are each used for a different energy of operation of the LINAC. Phase comparator A 83 compares the electromagnetic wave at the input of the accelerator structure 8 (P1A) and at the output of the accelerator structure 8 (P2A) and provides a measure of the phase shift ($\Delta P_A$) to the controller 82. Phase comparator B 84 compares the electromagnetic wave at the input of the accelerator structure 8 (P1B) and at the output of the accelerator structure 8 (P2B) and provides a measure of the phase shift ($\Delta P_B$) to the controller 82. The illustration of FIG. 8 includes two oscillators (oscillator 85 and oscillator 86), each used for a different energy of operation of the LINAC. Frequency controller 82 can transmit a signal to oscillator 85 to tune the frequency of oscillator 85 based on the measured phase shift $\Delta P_A$ of an electromagnetic wave used to accelerate a set of electrons to the desired first energy of operation. In addition, frequency controller 82 can also transmit a signal to oscillator 86 to tune the frequency of oscillator 86 based on the measured phase shift $\Delta P_B$ of an electromagnetic wave used to accelerate a set of electrons to the desired second energy of operation. As discussed above, oscillators 85 and 86 can each generate an RF signal having a frequency that is provided by the frequency controller, and the RF signal can be amplified by amplifier 88 and supplied to a klystron (not shown). Thus, the signal from the frequency controller to oscillator 85 (or oscillator 86) can ultimately result in a modification of the frequency of the electromagnetic wave that is coupled into the accelerator structure, for a given energy of operation, based on the magnitude of a phase shift detected by the frequency controller. The frequency controller is illustrated in FIG. 8 as comprising a controller 82, phase comparator A 83, and phase comparator B 84 as separate units. However, in other embodiments, the frequency controller can comprise the controller and the phase comparators as an integral unit.

Figure 9:
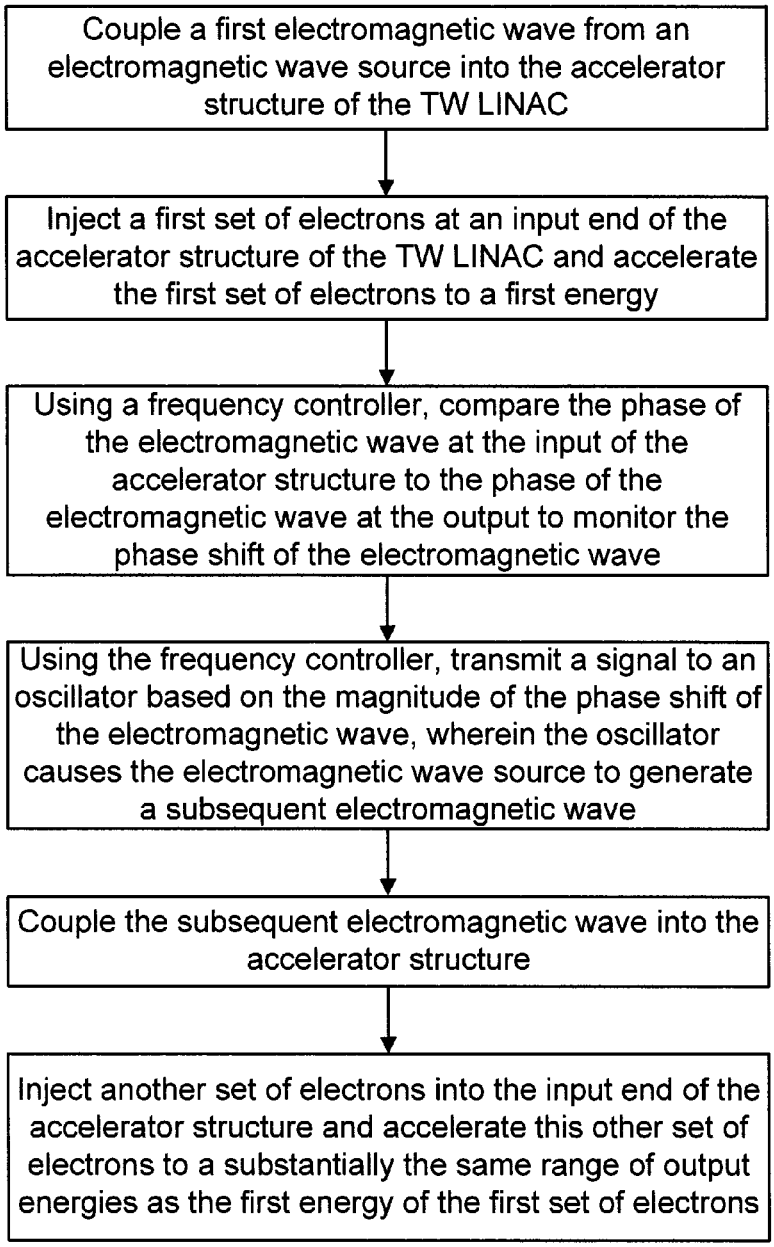
FIG. 9 shows a flow chart of an operation of a TW LINAC comprising a frequency controller.

FIG. 9 shows a flow chart of steps in an example operation of the TW LINAC. In step 90 of FIG. 9, a first electromagnetic wave from an electromagnetic wave source is coupled into the accelerator structure of the TW LINAC. In step 92, a first set of electrons is injected at the input of the accelerator structure of the TW LINAC and the first set of electrons is accelerated to a first energy. In step 94, a frequency controller compares the phase of the electromagnetic wave at the input of the accelerator structure to the phase of the electromagnetic wave at the output to monitor the phase shift of the electromagnetic wave. Step 94 can occur during the acceleration of the first set of electrons to a first energy in step 92. In step 96, the frequency controller transmits a signal to an oscillator, and the oscillator can cause the electromagnetic wave source to generate a subsequent electromagnetic wave at a corrected frequency based on the magnitude of the phase shift detected by the frequency controller. For example, the corrected frequency can differ from the first frequency by an amount $\delta f$ based on magnitude of the phase shift detected (for example, $\delta f$ can be a difference on the order of about 0.000001 MHz or more, about 0.00001 MHz or more, about 0.001 MHz or more, about 0.01 MHz or more, about 0.03 MHz or more, about 0.05 MHz or more, about 0.08 MHz or more, about 0.1 MHz or more, or about 0.15 MHz or more). The subsequent electromagnetic wave of step 98 has about the same amplitude as the electromagnetic wave of step 90. For example, these electromagnetic waves can have about the same magnitude if they differ by less than about 0.1%, less than about 1%, less that about 2%, less than about 5% in magnitude, less than about 10% in magnitude, or more. As discussed above, the oscillator can generate a signal having a frequency that is provided by the frequency controller, and that signal can be amplified by an amplifier and supplied to the electromagnetic wave source (such as a klystron). The electromagnetic wave source can generate the subsequent electromagnetic wave based on the amplified signal received from the amplifier. In step 98, the subsequent electromagnetic wave is coupled into the accelerator structure. In step 100, another set of electrons is injected at the input of the accelerator structure of the TW LINAC and this set of electrons is accelerated by the subsequent electromagnetic wave to substantially the same range of output energies as the first energy of the first set of electrons. The range of output energies of two different sets of electrons is substantially the same if the central value (e.g., the mean value or median value) of the range of output energies differs by less than about 0.1%, less than about 1%, less that about 2%, less than about 5% in magnitude, less than about 10% in magnitude, or more. Steps 90-100 can be repeated a number of times during operation of the TW LINAC.

In an interleaving operation, the LINAC can be operated to cycle between two different output energies. For example, the LINAC can be operated to alternate between about 6 MeV and about 9 MeV. In such an operation, after step 96 but prior to step 98, the LINAC can be operated at an energy (for example, about 9 MeV) that is different from the first energy of the first set of electrons (for example, about 6 MeV). The amplitude and frequency in the accelerator structure of the electromagnetic wave used for accelerating these additional electrons can be different than the electromagnetic wave used in step 90. For example, in the interleaving operation, a first electromagnetic wave is generated and used to accelerate a first set of electrons to the first energy, a second electromagnetic wave (of a different amplitude and frequency) is generated and used to accelerate a second set of electrons to a second energy that is different from the first energy, then a subsequent electromagnetic wave is generated based on the phase shift of the first electromagnetic wave (as discussed above) and used to accelerate a subsequent set of electrons to substantially the same range of energies as the first energy. In yet another example of an interleaving operation, the LINAC is operated for multiple pulses at the first energy before it is operated at the second energy. The LINAC can also be operated to provide multiple pulses at the first energy and then operated to provide multiple pulses at the second energy.

In another example operation, prior to step 90, a phase set point for the first energy can be input into the phase comparator. The phase shift can be inserted into one input arm of the phase comparator so that the phase comparator outputs a reading of, e.g., zero voltage, when the phase is correct for the desired energy of the pulse. In another example, after step 94 and prior to step 96, a phase set point for the second energy can be input into the phase comparator.

The frequency controller can have several different set points for the optimum phase shift for each of the different energies at which the TW LINAC is operated. For example, the frequency controller can have N different set points for the optimum phase shift that corresponds to each of N different energies ($N \geqq 2$) at which the TW LINAC is operated.

The frequency controller can perform the phase comparison continuously as a beam of electrons is accelerated in the accelerator structure. For example, frequency controller can perform the phase comparison continuously from the moment an electromagnetic wave is coupled into the input of the accelerator structure until the electrons are output from the output of the accelerator structure. The set point for the phase bridge can be changed before another electromagnetic wave is coupled into the accelerator structure, so that the set point is appropriate for the intended energy range of the subsequent pulse of output electrons.

The frequency controller can adjust the frequency to achieve the desired phase set point. For example, for a TW LINAC in which the accelerator structure is a forward wave structure, the frequency controller can transmit a signal to result in the raising of the frequency for the lower energy operation in which the electron beam is moving slower through the buncher region. In another example, for a TW LINAC in which the accelerator structure is a forward wave structure, the frequency controller can transmit a signal to result in the lowering of the frequency for the higher energy operation in which the electron beam is moving faster through the buncher region. The transit time of the electron beam through the buncher region can differ greatly from the lower energy operation to the higher energy operation when the electrons are being accelerated from, e.g., about 15 keV (an example energy of electrons emerging from an electron gun) to about 1 MeV. The difference in transit times results from the different electric field amplitudes being applied to the electrons for the lower energy beam versus the higher energy beam. For example, electric field amplitudes used for the lower energy beam can be about ⅔ as high as that used for the higher energy beam in a dual-energy operation. The frequency controller can transmit a signal to result in the adjustment of the frequency of the electromagnetic wave to make the transit time of the electromagnetic wave crests through the structure optimized for the transit time of the electrons through the accelerator structure for each of the different energies in the interleaved operation of the TW LINAC. For example, frequency controller can transmit a signal to provide electromagnetic wave crests whose transit time through the accelerator structure is longer for lower energy electron beams.

In examples where the accelerator structure is a backward wave structure, the sign of the frequency change in the foregoing discussions would be reversed. For example, if the frequency is raised to achieve a result for a forward wave structure, it is lowered to achieve that result for a backward wave structure.

Changing the frequency of the electromagnetic wave can change the phase velocity of the wave so that, at each electron beam energy, the electron bunch can be on the average on the crest of the wave. The TW LINAC can be configured so that, for one particular energy, termed the synchronous energy, the buncher region and the accelerating structure of the LINAC can be designed so that the bunch is near the crest all the way through the LINAC. If the TW LINAC is to be operated over a large energy range, e.g., energies ranging from 3 MeV to 9 MeV, the synchronous energy can be chosen to be near the middle of the operating range.

If the input power (and hence amplitude) of the electromagnetic wave is lowered to lower the fields, and thus lower the energy of the electron beam, the fields can decrease uniformly throughout the LINAC. However, the effect of the decrease in power of the electromagnetic wave (including decreased electron velocity) can be more concentrated in the buncher region, since the velocity of the electrons becomes considerably less sensitive to the power of the electromagnetic wave once the electrons approach relativistic speeds. A change in phase velocity of the wave resulting from a change in frequency for a constant gradient forward wave TW LINAC can be small at the input end of the accelerator structure and large at the output end. The frequency controller can transmit a signal to change the frequency of an electromagnetic wave such that the electron bunch travels substantially behind the crest in the first third of the accelerator structure, to reach the crest by around the middle of the accelerator structure, and to be substantially ahead of the crest in the last third of the accelerator structure. In this example, the energy correlation as a function of position within the electron bunch that the electrons gain in the first third of their travel through the LINAC can be removed by traveling ahead of the crest in the last third of their travel through the LINAC. The frequency adjustment that removes the energy correlation as a function of position can also maximize the energy gain through the LINAC, and can maximize the x-ray yield.

For a given energy of operation, the optimum frequency and the set point of the frequency controller can be functions of both the energy and the beam current from the electron gun. The beam current from the electron gun can be varied to change the output energy of the electrons through the beam loading effect. In the beam loading effect, the electron beam bunched at the operating frequency of the LINAC can induce a field in the accelerator structure that has a phase that opposes the acceleration applied by the electromagnetic wave coupled into the LINAC, and can act to oppose the forward motion of the electrons. That is, beam loading can induce fields that act to decelerate the electron beam. The amplitude of these induced fields vary linearly with the magnitude of the beam current, and can rise roughly linearly with distance along the accelerator structure. A higher electron beam current can induce electric fields of higher amplitude that oppose the acceleration applied by the electromagnetic wave coupled into the LINAC, and result in the electron beam experiencing less acceleration. In effect, beam loading can decrease the amplitude of the electromagnetic wave. A desirable result of increasing the electron gun current (and hence the effect of beam loading) to lower the energy of the output electrons can be that the x-ray yield can be increased, for example, from the increased dose rate of electrons.

The beam loading effect can lower the energy of the electron beam, while having little effect on the transit time of the electron beam through the accelerator, since the electron beam induced fields are small at the input end where the electron beam is non-relativistic. If the power of the electromagnetic wave is raised in an effort to compensate for the lowered energy that can result from beam loading, the fields can change equally in all cavities of the accelerator structure and have a strong effect on the beam transit time through the accelerator structure. Thus, for each different energy in an interleaving operation, an adjustment in the set point of the frequency controller can be made to account for the different RF phase shifts through the LINAC that can occur for each different energy of operation, for example, due to the effect of beam loading.

In a multi-energy operation of the LINAC, the electron gun can be operated at a different beam current for each energy of operation. As discussed above, increasing the beam current for the lower energy operation can provide an increased x-ray yield at the lower energy than achieved by just lowering the amplitude of the electromagnetic wave from the klystron. Using a different beam current from the electron gun for each different energy of operation of the LINAC can help maintain the same x-ray intensity across the different energies of operation.

In another embodiment, an operator can choose a phase shift through the LINAC for each different energy which maximizes the X-ray yield for that energy. That is, an operator can choose the set point of the frequency controller for each different energy of operation. The frequency controller can then continuously adjust the frequency of the electromagnetic wave to maintain the phase of the electromagnetic wave at the preset phase set point for that energy. It appears that a similar value of phase shift through the LINAC can optimize the electron spectrum (i.e., eliminate the energy correlation with position in the bunch along the longitudinal direction of the LINAC), maximize the energy, and maximize the x-ray yield. However, maximizing the x-ray yield can be sensitive to frequency and can be easy to perform.

In an embodiment, the frequency controller can maintain automatic control over the adjustments to the frequency of the electromagnetic wave in a feedback operation. In a non-limiting example, the frequency controller can be an automatic frequency controller (AFC).

In another embodiment, a frequency controller can maintain automatic control and adjust the frequency of the electromagnetic wave to stabilize the energy of the electrons output at a given energy of operation. The energy of the electrons are stabilized when the energy spectrum of the electrons is centered at or substantially near the desired energy of operation of the accelerator (i.e., the maximum attainable energy of the LINAC for the given electromagnetic fields), and the full-width at half-maximum of the energy spectrum of the output electrons is minimized (i.e., narrowed). All of the systems and methods disclosed herein are also applicable to this embodiment of the operation of the TW LINAC comprising the frequency controller. For example, the frequency controller can maintain automatic control and adjust the frequency of the electromagnetic wave to stabilize the energy of the electrons at each energy of operation. In this example, the frequency controller can compare a first output of electrons at an energy to a second output of electrons at that same energy, and frequency controller transmits a signal to an oscillator, and adjust the frequency of the electromagnetic wave to stabilize the output of electrons. The frequency of the electromagnetic wave can be varied on alternate pulses of the same energy to determine the behavior of the measured output of electrons versus frequency, and thus determine the change in frequency that can cause the output of electrons to peak around the desired energy, with minimized energy spread.

In another embodiment, the frequency controller can maintain automatic control and adjust the frequency of the electromagnetic wave to maximize the yield of x-rays at each energy (generated by contacting a target with the output electrons). For example, the frequency controller can transmit a signal to adjust the frequency of the electromagnetic wave based on the measured yield of x-rays. The maximum of the yield of x-rays at a given energy of the interleaving operation can be predetermined The frequency of the electromagnetic wave can be varied on alternate pulses of the same energy to determine the behavior of the measured yield of x-rays versus frequency, and thus determine the change in frequency that can cause the yield to move towards the maximum. In this example, the yield of x-rays on two successive pulses at the same energy can be compared to determine the adjustment to the electromagnetic wave frequency. In a specific embodiment, the frequency can be varied by about 100 kHz on alternate pulses of the same energy, resulting in a change in phase through the structure of about 8 degrees of phase. With this frequency variation, the electron bunch can alternate between about 2 degrees forward and about 2 degrees behind the crest of the electromagnetic wave on successive pulses of the same energy.

The frequency controller can maintain automatic control over the adjustments to the frequency of the electromagnetic wave in a feedback operation. A feedback loop can be intricate and the convergence time to determine a frequency adjustment can be long. The convergence time can be reduced by making the frequency correction (or adjustment) proportional to the error signal. In the embodiment where the frequency controller is used to maximize the yield of x-rays at each energy of operation, the error signal can be determined as the difference between the x-ray yield from two pulses, divided by the sum of the x-ray yields from the two pulses. The energy of the beam can be approximated as a sine function of phase shift through the LINAC. Normalizing by the sum of the two x-ray yields can cause the error signal measure to be insensitive to changes in the x-ray measurement device. In the embodiment where the frequency controller is used to stabilize the energy of the output electrons at each energy of operation, the error signal can be determined as the difference between the electron current from two pulses, divided by the sum of the electron currents from the two pulses.

A frequency controller operated in a feedback operation can be used to correct for the effect of minor drifts of the electron gun current or minor drifts of the RF power (hence amplitude). That is, in addition to correcting for drifts in the temperature of the accelerator structure or drifts in the frequency of the oscillator.

6.4 X-Rays

In certain aspects, x-rays can be generated from the bombardment of a target material by the accelerated electron beam or electron bunches from a LINAC. The x-rays can be generated by two different mechanisms. In the first mechanisms, collision of the electrons from the LINAC an atom of a target can impart enough energy so that electrons from the atom's lower energy levels (inner shell) escape the atom, leaving vacancies in the lower energy levels. Electrons in the higher energy levels of the atom descend to the lower energy level to fill the vacancies, and emit their excess energy as x-ray photons. Since the energy difference between the higher energy level and the lower energy level is a discrete value, these x-ray photons (generally referred to as k-shell radiation) appear in the x-ray spectrum as sharp lines (called characteristic lines). K-shell radiation has a signature energy that depends on the target material. In the second mechanisms, the electron beams or bunches from the LINAC are scattered by the strong electric field near the atoms of the target and give off Bremsstrahlung radiation. Bremsstrahlung radiation produces x-rays photons in a continuous spectrum, where the intensity of the x-rays increases from zero at the energy of the incident electrons. That is, the highest energy x-ray that can be produced by the electrons from a LINAC is the highest energy of the electrons when they are emitted from the LINAC. The Bremsstrahlung radiation can be of more interest than the characteristic lines for many applications.

Materials useful as targets for generating x-rays include tungsten, certain tungsten alloys (such as but not limited to tungsten carbide, or tungsten (95%)-rhenium (5%)), molybdenum, copper, platinum and cobalt.

6.5 Instrumentation

Certain instruments which may be used in the operation of a traveling wave LINAC include a klystron modulator and an electromagnetic wave source.

6.5.1 Modulator

A modulator generates high-voltage pulses lasting a few microseconds. These high-voltage pulses can be supplied to the electromagnetic wave source (discussed in Section 6.5.2 below), to the electron gun (see Section 6.1 above), or to both simultaneously. A power supply provides DC voltage to the modulator, which converts this to the high-voltage pulses. For example, the Solid State Klystron Modulator -K1 or -K2 (ScandiNova Systems AB, Uppsala, Sweden) can be used in connection with a klystron.

6.5.2 Microwave Generators

The electromagnetic wave source can be any electromagnetic wave source deemed suitable by one of skill. The electromagnetic wave source (in the microwave of radio frequency ("RF") range) for the LINAC can be a klystron amplifier (discussed in Section 6.1 above). In a klystron, the size of the RF source and the power output capability are roughly proportional to the wavelength of the electromagnetic wave. The electromagnetic wave can be modified by changing its amplitude, frequency, or phase.

6.6 Exemplary Apparatus and Computer-Program Implementations

Aspects of the methods disclosed herein can be performed using a computer system, such as the computer system described in this section, according to the following programs and methods. For example, such a computer system can store and issue commands to facilitate modification of the electromagnetic wave frequency according to a method disclosed herein. In another example, a computer system can store and issue commands to facilitate operation of the frequency controller according to a method disclosed herein. The systems and methods may be implemented on various types of computer architectures, such as for example on a single general purpose computer, or a parallel processing computer system, or a workstation, or on a networked system (e.g., a client-server configuration such as shown in FIG. 10).

Figure 10:
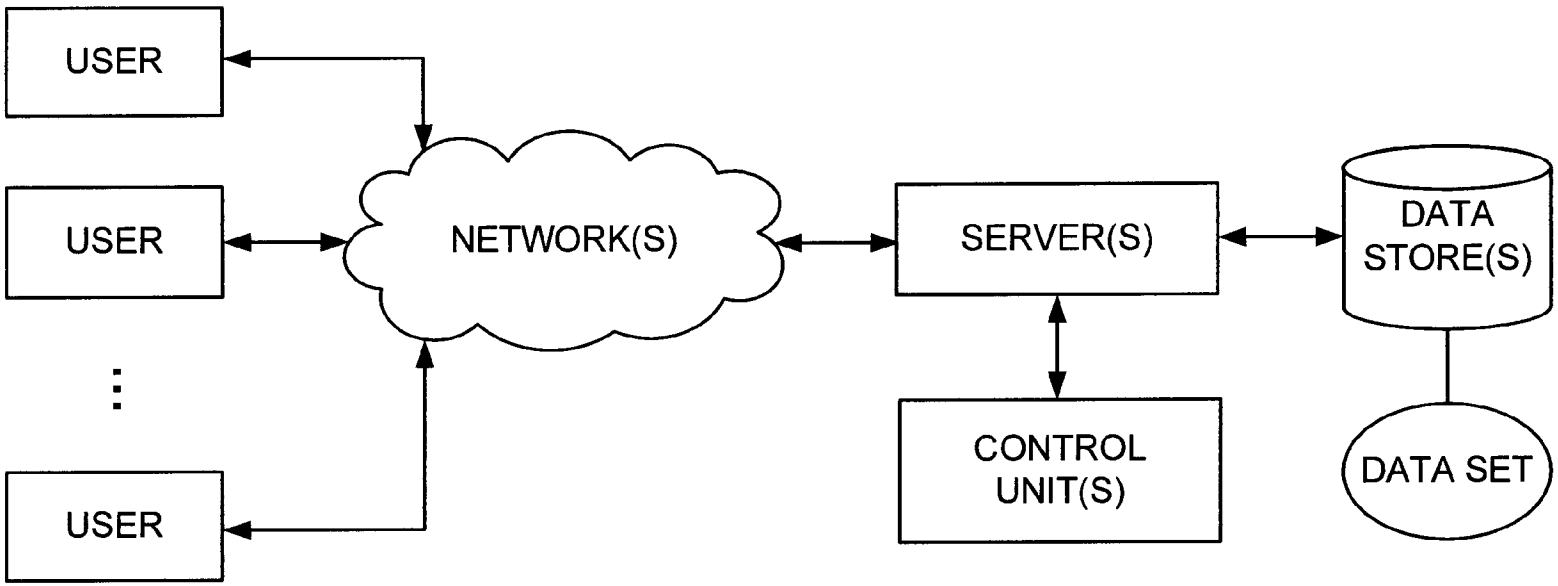
FIG. 10 shows a block diagram of an example computer structure for use in the operation of a TW LINAC comprising a frequency controller.

An exemplary computer system suitable for implementing the methods disclosed herein is illustrated in FIG. 10. As shown in FIG. 10, the computer system to implement one or more methods and systems disclosed herein can be linked to a network link which can be, e.g., part of a local area network ("LAN") to other, local computer systems and/or part of a wide area network ("WAN"), such as the Internet, that is connected to other, remote computer systems. A software component can include programs that cause one or more processors to issue commands to one or more control units, which cause the one or more control units to issue commands to cause the initiation of the frequency controller, to operate the electromagnetic wave source to generate an electromagnetic wave at a frequency, and/or to operate the LINAC (including commands for coupling the electromagnetic wave into the LINAC). The programs can cause the system to retrieve commands for executing the steps of the methods in specified sequences, including initiating the frequency controller and operating the electromagnetic wave source to generate an electromagnetic wave at a frequency, from a data store (e.g., a database). Such a data store can be stored on a mass storage (e.g., a hard drive) or other computer readable medium and loaded into the memory of the computer, or the data store can be accessed by the computer system by means of the network.

In addition to the exemplary program structures and computer systems described herein, other, alternative program structures and computer systems will be readily apparent to the skilled artisan. Such alternative systems, which do not depart from the above described computer system and programs structures either in spirit or in scope, are therefore intended to be comprehended within the accompanying claims.

7. Results

Certain results have been discussed previously. This section provides additional results or further discusses some of the results already discussed hereinabove.

Figure 11:
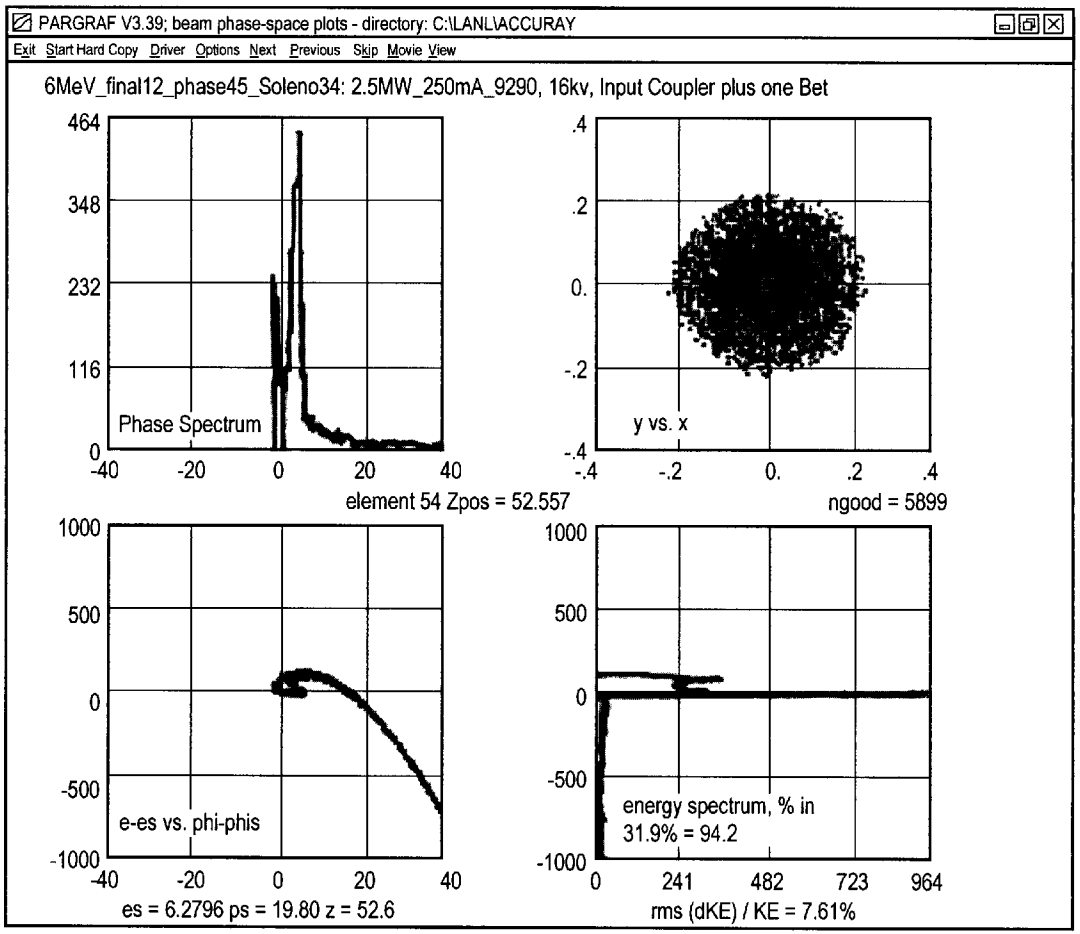
FIG. 11 illustrates a first set of 4 plots from a PARMELA simulation.
Figure 12:
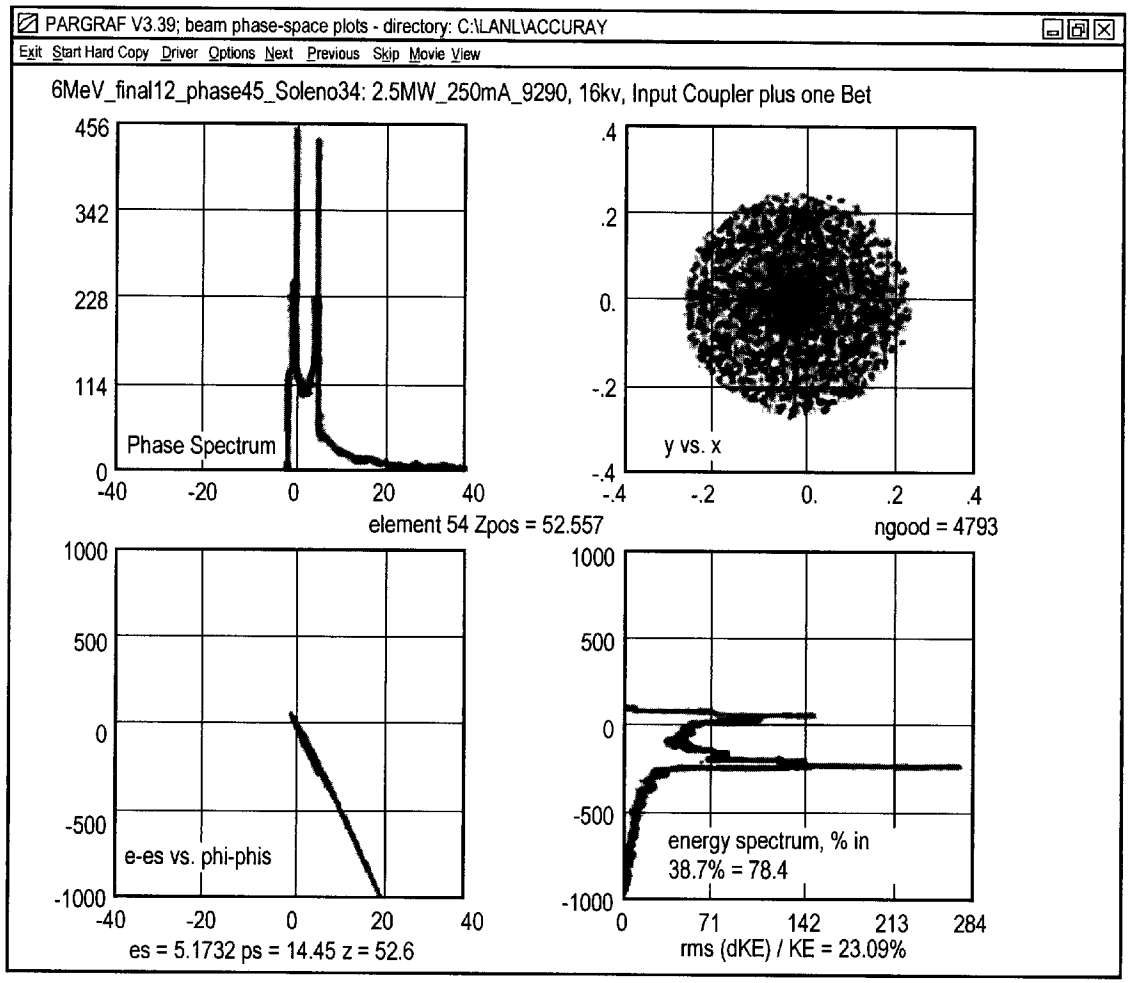
FIG. 12 illustrates results for a 6 MeV beam in which the frequency is the same for the 6 MeV beam and the 9 MeV beam.
Figure 13:
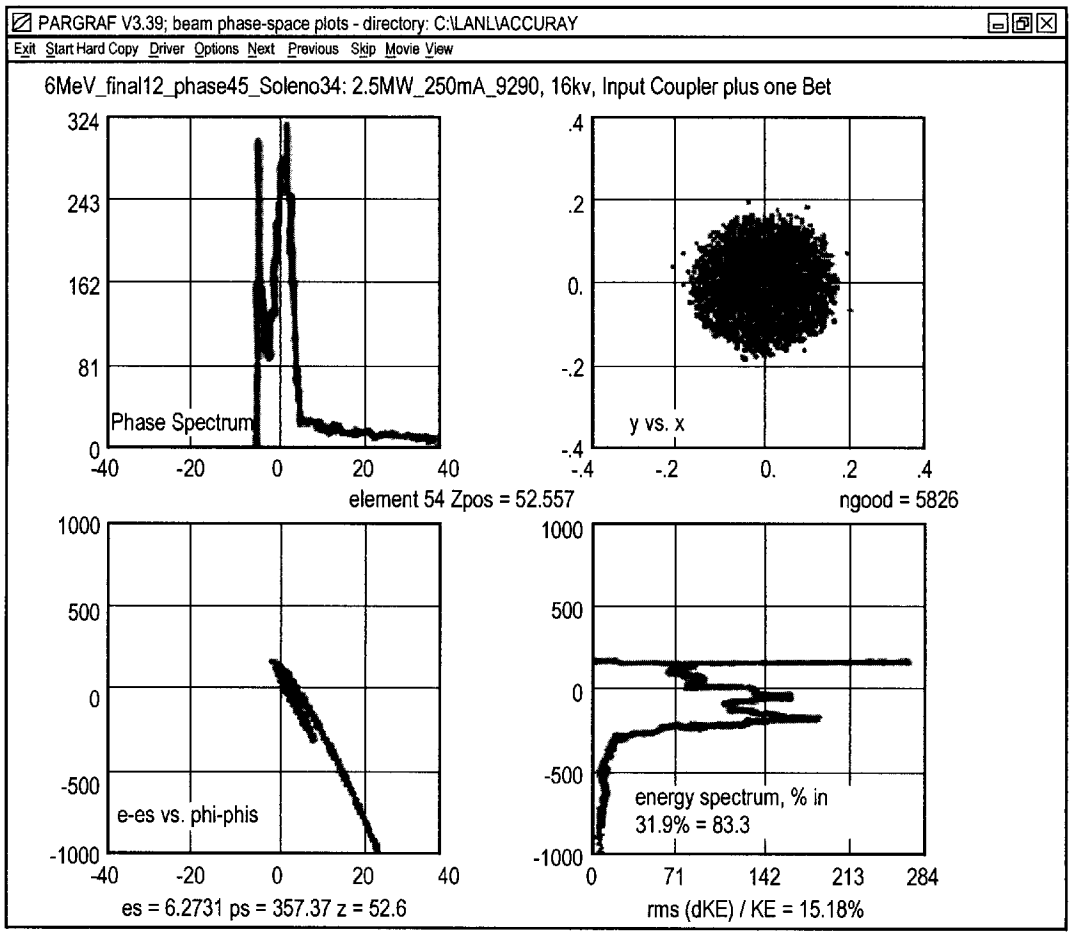
FIG. 13 illustrates results for a 6.3 MeV beam in which the frequency is the same for the 6.3 MeV beam and the 9 MeV beam.

An example of the beneficial effect of changing the frequency of the RF electromagnetic wave for a lower energy beam can be seen from a design of a single section accelerator with an integral buncher intended to run with interleaved beams of 9 MeV and 6 MeV. FIGS. 11-13 illustrate plots from a phase and radial motion in electron LINACs (PARMELA) simulation showing the advantages of modifying the frequency for the lower energy beam.

FIG. 11 illustrates a first set of 4 plots from the PARMELA simulation. FIG. 11 illustrates results for a 6 MeV beam in which the frequency has been raised approximately 1 MHz from the 9 MeV beam. The 1 MHz increase in frequency optimizes the spectrum at 6 Mev and minimizes energy jitter by putting the bunch on average on the crest of the sine wave of the RF electromagnetic wave. The change in frequency for the 6 MeV beam changes the phase shift through the accelerator structure by about 80 degrees as compared to the 9 MeV beam. This causes the center of the bunch to drift from about 35 degrees behind the crest to 45 degrees in front of the crest for an average position 5 degrees ahead of the crest. This can maximize the charge in about a 2% spectrum, and may minimize an intensity jitter of the x-ray yield.

The top left hand plot in FIG. 11 is the distribution of charge in the electron bunch, with the horizontal axis representing calibrated degrees of RF phase and the vertical axis representing number of macro particles per bin. Each bin is 0.4 degrees wide for a total of 200 bins. The lower left plot is the distribution of electrons in longitudinal phase space with the horizontal axis the same as the plot above, and the vertical axis is energy in keV relative to a reference particle. The lower right hand plot is the energy spectrum with the vertical axis representing energy and the horizontal axis representing number of electrons per bin. The upper right plot is the distribution of electrons in transverse (x/y) space as it would appear on a screen.

FIG. 12 illustrates results for a 6 MeV beam in which the frequency is the same for the 6 MeV beam and the 9 MeV beam. In FIG. 12, the electron bunch is about 35 degrees behind the crest throughout the accelerator structure. Therefore, the spectrum is wide, and the resultant energy is about 5.1 MeV. This requires the strength of the electromagnetic waves to be increased to deliver the specified 6 MeV beam. For the illustrated 6 MeV beam, anything that causes phase jitter will cause a large jitter in electron energy and even larger jitter in x-ray intensity.

FIG. 13 illustrates results for a 6.3 MeV beam in which the frequency is the same for the 6.3 MeV beam and the 9 MeV beam. In FIG. 13, the bunch is about 24 degrees behind the crest of the electromagnetic wave. Since the bunch is still well off the crest, any phase jitter will still cause a very significant x-ray intensity jitter.

As shown by the comparison between FIGS. 11, 12 and 13, significant improvements in resistance to phase jitter and resistance to x-ray intensity jitter can be achieved by adjusting the frequency between different energy levels of a multi-energy TW LINAC. Adjusting the frequency between the different energy levels can also reduce the power that needs to be supplied by the RF electromagnetic waves.

What is claimed is:

1. A traveling wave linear accelerator for accelerating electrons generated by an electron gun, the traveling wave linear accelerator comprising:

an accelerator structure configured to receive the electrons generated by the electron gun and having an input, a buncher configured to pack the received electrons into bunches and produce an initial acceleration, and an output;

an electromagnetic wave source coupled to the accelerator structure to provide an electromagnetic wave for further accelerating the electron bunches through the accelerator structure, the electromagnetic wave having crests relative to which the electron bunches are positioned;

an oscillator coupled to the electromagnetic wave source and configured to control the frequency of the electromagnetic wave provided by the electromagnetic wave source; and a frequency controller interfaced with the input of the accelerator structure and with the output of the accelerator structure and configured to compare the phase of the electromagnetic wave at the input of the accelerator structure to the phase of the electromagnetic wave at the output of the accelerator structure so as to detect a phase shift of the electromagnetic wave in the accelerator structure, wherein the frequency controller is configured to transmit a signal to the oscillator based on the magnitude of the detected phase shift, and wherein responsive to the signal the oscillator causes the electromagnetic wave source to generate a subsequent electromagnetic wave at a modified frequency, wherein the position of the electron bunches relative to the crests of the electromagnetic wave changes responsive to the modified frequency.

2. The traveling wave linear accelerator of claim 1, further comprising an amplifier, wherein the frequency signal from the oscillator is amplified by the amplifier, and wherein the amplifier supplies the amplified frequency signal to the electromagnetic wave source.

3. The traveling wave linear accelerator of claim 1, wherein the electromagnetic wave source is a klystron.

4. The traveling wave linear accelerator of claim 1, further comprising an electron gun, wherein the accelerator structure accelerates a first electron beam from the electron gun to a first energy using a first electromagnetic wave provided by the electromagnetic wave source, the first electromagnetic wave having a first amplitude and a first frequency in the accelerator structure, wherein the frequency controller monitors a first phase shift of the first electromagnetic wave, and transmits a first signal to the oscillator based on the magnitude of the first phase shift, wherein the accelerator structure accelerates a second electron beam from the electron gun to a second energy using a second electromagnetic wave provided by the electromagnetic wave source, the second electromagnetic wave having a second amplitude and a second frequency in the accelerator structure, and wherein the frequency controller monitors a second phase shift of the second electromagnetic wave, and transmits a second signal to the oscillator based on the magnitude of the second phase shift.

5. The traveling wave linear accelerator of claim 4, wherein the first energy and the second energy are interleaved.

6. The traveling wave linear accelerator of claim 4, wherein the second amplitude is different from the first amplitude and the second frequency is different from the first frequency in the accelerator structure, and the second energy is different from the first energy.

7. The traveling wave linear accelerator of claim 4, further comprising a target, wherein the first electron beam is emitted from the output of the accelerator structure at the first energy and contacts the target to produce a first beam of x-rays at a first range of x-ray energies, and wherein the second electron beam is emitted from the output of the accelerator structure at the second energy and contacts the target to produce a second beam of x-rays at a second range of x-ray energies.

8. A method of operating a traveling wave linear accelerator for accelerating electrons generated by an electron gun, comprising:

receiving at an input of an accelerator structure of the traveling wave linear accelerator a first electromagnetic wave having a first amplitude and a first frequency from an electromagnetic wave source;

controlling the frequency of the electromagnetic wave with an oscillator;

receiving at the accelerator structure a first electron beam generated by the electron gun;

packing the electrons of the first electron beam into bunches and producing an initial acceleration;

generating a first output of electrons having a first energy from an output of the accelerator structure by accelerating the electron bunches of the first electron beam using the first electromagnetic wave, the first electromagnetic wave having crests relative to which the electron bunches have a first position; and monitoring a first phase shift of the first electromagnetic wave using a frequency controller interfaced with the input of the accelerator structure and with the output of the accelerator by comparing a phase of the first electromagnetic wave at the input of the accelerator structure to a phase of the first electromagnetic wave near the output of the accelerator structure, wherein the frequency controller transmits a first signal to the oscillator based on the first phase shift, and wherein the oscillator causes the electromagnetic wave source to generate a second electromagnetic wave having a second frequency in the accelerator structure based on the first signal, wherein the electron bunches of the first electron beam have a second position relative to the crests of the second electromagnetic wave.

9. The method of claim 8, further comprising contacting the first output of electrons with a target to produce a first beam of x-rays at a first range of x-ray energies.

10. The method of claim 9, further comprising generating a second output of electrons having a second energy from the output of the accelerator structure by accelerating a second electron beam using the second electromagnetic wave.

11. The method of claim 10, wherein the second energy is the same as the first energy.

12. The method of claim 10, wherein the second frequency is different from the first frequency and the second energy is different from the first energy.

13. The method of claim 10, wherein the first energy and the second energy are interleaved.

14. The method of claim 8, wherein the electromagnetic wave source is a klystron.

15. The method of claim 8, further comprising:

receiving at an input of the accelerator structure a third electromagnetic wave having a third amplitude and a third frequency from the electromagnetic wave source;

receiving at the accelerator structure a third electron beam generated by the electron gun;

packing the electrons of the third electron beam into bunches and producing an initial acceleration;

generating a third output of electrons having a third energy, different from the first energy, by accelerating the electron bunches of the third electron beam using the third electromagnetic wave, the third electromagnetic wave having crests relative to which the electron bunches of the third electron beam have a third position; and monitoring a third phase shift of the third electromagnetic wave using the frequency controller by comparing a phase of the third electromagnetic wave at the input of the accelerator structure to a phase of the third electromagnetic wave at the output of the accelerator structure, wherein the frequency controller transmits a third signal to the oscillator based on the third phase shift, and wherein the oscillator causes the electromagnetic wave source to generate a fourth electromagnetic wave having a fourth frequency in the accelerator structure based on the third signal, wherein the electron bunches of the third electron beam have a fourth position relative to the crests of the fourth electromagnetic wave.

* * * * *